US006846525B2

(12) United States Patent
Malhotra

(10) Patent No.: US 6,846,525 B2
(45) Date of Patent: Jan. 25, 2005

(54) RECORDING SHEETS CONTAINING PURINE, PYRIMIDINE, BENZIMIDAZOLE, IMIDAZOLIDINE, URAZOLE, PYRAZOLE, TRIAZOLE, BENZOTRIAZOLE, TETRAZOLE, AND PYRAZINE COMPOUNDS

(75) Inventor: Shadi L. Malhotra, Mississauga (CA)

(73) Assignee: Xerox Corporation, Stamford, CT (US)

( * ) Notice: Subject to any disclaimer, the term of this patent is extended or adjusted under 35 U.S.C. 154(b) by 8 days.

(21) Appl. No.: 08/196,933

(22) Filed: Feb. 15, 1994

(65) Prior Publication Data

US 2004/0202825 A1 Oct. 14, 2004

Related U.S. Application Data

(63) Continuation-in-part of application No. 08/033,917, filed on Mar. 19, 1993, now Pat. No. 5,441,795, and a continuation-in-part of application No. 08/033,918, filed on Mar. 19, 1993, now Pat. No. 5,457,486.

(51) Int. Cl.[7] ..... B41M 5/00

(52) U.S. Cl. ..... 428/32.14; 428/32.1; 428/32.19; 428/32.21; 428/195.1

(58) Field of Search ..... 428/323, 336, 428/483, 500, 509, 523, 145, 32.1, 32.14, 32.19, 32.21, 195.1

(56) References Cited

U.S. PATENT DOCUMENTS

| | | | | | |
|---|---|---|---|---|---|
| 4,013,473 | A | * | 3/1977 | Willem et al. | |
| 4,111,703 | A | * | 9/1978 | Lawton | 523/161 |
| 4,288,523 | A | * | 9/1981 | Taylor | 430/215 |
| 4,371,582 | A | | 2/1983 | Sugiyama et al. | 428/341 |
| 4,446,174 | A | | 5/1984 | Maekawa et al. | 427/261 |
| 4,523,208 | A | * | 6/1985 | Barzynski | |
| 4,554,181 | A | | 11/1985 | Cousin et al. | 427/261 |
| 4,576,867 | A | | 3/1986 | Miyamoto | 428/342 |
| 4,620,197 | A | | 10/1986 | Miyamoto et al. | 346/1.1 |
| 4,740,420 | A | | 4/1988 | Akutsu et al. | 428/341 |
| 4,781,985 | A | | 11/1988 | Desjarlais | 428/421 |
| 4,785,313 | A | * | 11/1988 | Higuma et al. | 346/135.1 |
| 4,830,911 | A | | 5/1989 | Kojima et al. | 428/342 |
| 4,855,282 | A | * | 8/1989 | Satomura et al. | 503/218 |
| 4,877,680 | A | | 10/1989 | Sakaki et al. | 428/332 |
| 4,946,741 | A | | 8/1990 | Aono et al. | 428/336 |
| 4,970,307 | A | * | 11/1990 | Takeda et al. | 540/579 |
| 5,073,448 | A | | 12/1991 | Vieira et al. | 428/331 |
| 5,185,213 | A | * | 2/1993 | Fujita et al. | |
| 5,212,008 | A | | 5/1993 | Malhotra et al. | 428/216 |
| 5,220,346 | A | | 6/1993 | Carreira et al. | 346/1.1 |
| 5,223,338 | A | | 6/1993 | Malhotra | 428/342 |
| 5,229,246 | A | * | 7/1993 | Shibata et al. | |
| 5,278,249 | A | * | 1/1994 | Marrion | 428/500 |
| 5,286,618 | A | * | 2/1994 | Tachibana et al. | 430/529 |
| 5,656,378 | A | * | 8/1997 | Lambert | |

FOREIGN PATENT DOCUMENTS

| | | | | |
|---|---|---|---|---|
| EP | 0 280 650 | | 8/1988 | |
| EP | 0439363 | | 7/1991 | |
| GB | 2 088 777 | | 6/1982 | |
| JP | 5790071 | * | 6/1982 | 428/195 |
| JP | 61 177279 | | 8/1986 | |
| JP | 61-177279 | * | 8/1986 | |
| JP | 62 221591 | | 9/1987 | |
| ZA | 924610 | | 6/1992 | |

* cited by examiner

*Primary Examiner*—Pamela R. Schwartz
(74) *Attorney, Agent, or Firm*—Judith L. Byorick

(57) ABSTRACT

Disclosed is a recording sheet which comprises a substrate and a material selected from the group consisting of purine compounds, pyrimidine compounds, benzimidazole compounds, imidazolidine compounds, urazole compounds, pyrazole compounds, triazole compounds, benzotriazole compounds, tetrazole compounds, pyrazine compounds, and mixtures thereof. Also disclosed is a recording sheet which consists essentially of a substrate, at least one material selected from the group consisting of purine compounds, pyrimidine compounds, benzimidazole compounds, imidazolidine compounds, urazole compounds, pyrazole compounds, triazole compounds, benzotriazole compounds, tetrazole compounds, pyrazine compounds, and mixtures thereof, an optional binder, an optional antistatic agent, an optional biocide, and an optional filler.

36 Claims, No Drawings

RECORDING SHEETS CONTAINING PURINE, PYRIMIDINE, BENZIMIDAZOLE, IMIDAZOLIDINE, URAZOLE, PYRAZOLE, TRIAZOLE, BENZOTRIAZOLE, TETRAZOLE, AND PYRAZINE COMPOUNDS

This application is a continuation-in-part of application U.S. Ser. No. 08/033,917, filed Mar. 19, 1993, entitled "Recording Sheets Containing Pyridinium Compounds", now U.S. Pat. No. 5,441,795, and application U.S. Ser. No. 08/033,918, filed Mar. 19, 1993, entitled "Recording Sheets Containing Tetrazolium Indolinium, and Imidazolinium Compounds", now U.S. Pat. No. 5,457,486, the disclosures of each of which are totally incorporated herein by reference.

BACKGROUND OF THE INVENTION

The present invention is directed to recording sheets, such as transparency materials, filled plastics, papers, and the like. More specifically, the present invention is directed to recording sheets particularly suitable for use in ink jet printing processes. One embodiment of the present invention is directed to a recording sheet which comprises a substrate and a material selected from the group consisting of purine compounds, pyrimidine compounds, benzimidazole compounds, imidazolidine compounds, urazole compounds, pyrazole compounds, triazole compounds, benzotriazole compounds, tetrazole compounds, pyrazine compounds, and mixtures thereof. Another embodiment of the present invention is directed to a recording sheet which consists essentially of a substrate, at least one material selected from the group consisting of purine compounds, pyrimidine compounds, benzimidazole compounds, imidazolidine compounds, urazole compounds, pyrazole compounds, triazole compounds, benzotriazole compounds, tetrazole compounds, pyrazine compounds, and mixtures thereof, an optional binder, an optional antistatic agent, an optional biocide, and an optional filler.

Recording sheets suitable for use in ink jet printing are known. For example, U.S. Pat. No. 4,740,420 (Akutsu et al.) discloses a recording medium for ink jet printing comprising a support material containing at least in the surface portion thereof a water soluble metal salt with the ion valence of the metal thereof being 2 to 4 and a cationic organic material. The cationic organic materials include salts of alkylamines, quaternary ammonium salts, polyamines, and basic latexes.

U.S. Pat. No. 4,576,867 (Miyamoto) discloses an ink jet recording paper with improved water resistance and sunlight fastness of the image formed on the paper wherein the recording paper has attached to its surface a cationic resin of the formula

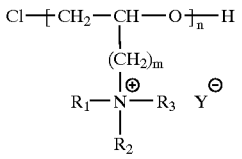

wherein $R_1$, $R_2$, and $R_3$ represent alkyl groups, m represents a number of 1 to 7, and n represents a number of 2 to 20, and Y represents an acid residue.

U.S. Pat. No. 4,446,174 (Maekawa et al.) discloses an ink jet recording method for producing a recorded image on an image receiving sheet with a jet of aqueous ink, wherein an ink jet is projected onto an image receiving sheet comprising a surface layer containing a pigment, and wherein the surface layer is capable of adsorbing a coloring component in the aqueous ink. Poly (vinyl benzyl trimethyl ammonium chloride), poly(diallyl dimethyl ammonium chloride), and poly(methacryloxyethyl-β-hydroxyethyl dimethyl ammonium chloride) are disclosed as dye absorbing adhesive materials.

U.S. Pat. No. 4,830,911 (Kojima et al.) discloses a recording sheet for ink jet printers which gives an image by the use of an aqueous ink containing a water-soluble dye, coated or impregnated with either of or a mixture of two kinds of water soluble polymers, one whose polymeric unit is alkylquaternaryammonium(meth)acrylate and the other whose polymer unit is alkylquaternaryammonium(meth) acrylamide, wherein the water soluble polymers contain not less than 50 mol percent of a monomer represented by the formula

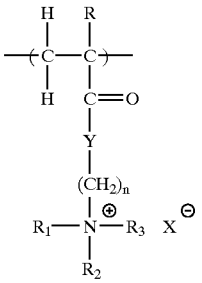

where R represents hydrogen or methyl group, n is an interger from 1 to 3 inclusive, $R_1$, $R_2$, and $R_3$ represent hydrogen or the same or different aliphatic alkyl group with 1 to 4 carbon atoms, X represents an anion such as a halogen ion, sulfate ion, alkyl sulfate ion, alkyl sulfonate ion, aryl sulfonate ion, and acetate ion, and Y represents oxygen or imino group.

U.S. Pat. No. 4,554,181 (Cousin et al.) discloses an ink jet recording sheet having a recording surface which includes a combination of a water soluble polyvalent metal salt and a cationic polymer, the polymer having cationic groups which are available in the recording surface for insolubilizing an anionic dye.

U.S. Pat. No. 4,877,680 (Sakaki et al.) discloses a recording medium comprising a substrate and a nonporous ink receiving layer. The ink receiving layer contains a water-insoluble polymer containing a cationic resin. The recording medium may be employed for recording by attaching droplets of a recording liquid thereon.

European Patent Publication 0 439 363 A1, published Jul. 31, 1991, corresponding to copending application U.S. Ser. No. 07/469,985, filed Jan. 25, 1990, the disclosure of which is totally incorporated herein by reference, discloses a paper which comprises a supporting substrate with a coating comprising (a) a desizing component selected from the group consisting of (1) hydrophilic poly(dialkylsiloxanes); (2) poly(alkylene glycol); (3) poly(propylene oxide)—poly (ethylene oxide) copolymers; (4) fatty ester modified compounds of phosphate, sorbitan, glycerol, poly(ethylene glycol), sulfosuccinic acid, sulfonic acid and alkyl amine; (5) poly(oxyalkylene) modified compounds of sorbitan esters, fatty amines, alkanol amides, castor oil, fatty acids and fatty alcohols; (6) quaternary alkosulfate compounds; (7) fatty imidazolines; and mixtures thereof, and (b) a hydrophilic binder polymer. The binder polymer may be a quaternary ammonium copolymer such as Mirapol WT, Mirapol AD-1, Mirapol AZ-1, Mirapol A-15, Mirapol-9, Merquat-100, or Merquat-550, available from Miranol Incorporated.

U.S. Pat. No. 5,223,338 (Malhotra), the disclosure of which is totally incorporated herein by reference, discloses a recording sheet which comprises a substrate and a coating consisting essentially of (1) quaternary ammonium polymers selected from the group consisting of (a) polymers of Formula I

I

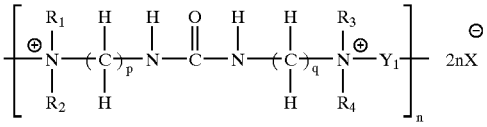

wherein n is an integer of from 1 to about 200, $R_1$, $R_2$, $R_3$, and $R_4$ are each independently selected from the group consisting of alkyl groups, hydroxyalkyl groups, and polyoxyalkylene groups, p is an integer of from 1 to about 10, q is an integer of from 1 to about 10, X is an anion, and $Y_1$ is selected from the group consisting of —$CH_2CH_2OCH_2CH_2$—, —$CH_2CH_2OCH_2CH_2OCH_2CH_2$—, —$(CH_2)_k$—, wherein k is an integer of from about 2 to about 10, and —$CH_2CH(OH)CH_2$—; (b) polymers of Formula II

II

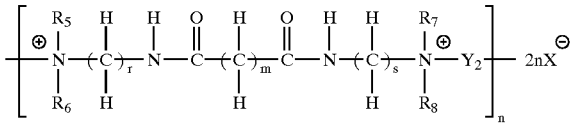

wherein n is an integer of from 1 to about 200, $R_5$, $R_6$, $R_7$, and $R_8$ are each independently selected from the group consisting of alkyl groups, hydroxyalkyl groups, and polyoxyalkylene groups, m is an integer of from 0 to about 40, r is an integer of from 1 to about 10, s is an integer of from 1 to about 10, X is an anion, and $Y_2$ is selected from the group consisting of —$CH_2CH_2OCH_2CH_2$—, —$CH_2CH_2OCH_2CH_2OCH_2CH_2$—, —$(CH_2)_k$—, wherein k is an integer of from about 2 to about 10, and —$CH_2CH(OH)CH_2$—; (c) copolymers of Formula III polymers of Formula I and polymers of Formula II; (e) mixtures of polymers of Formula I and copolymers of Formula III; (f) mixtures of polymers of Formula II and copolymers of Formula III; and (g) mixture of polymers of Formula I, polymers of Formula II, and copolymers of Formula III; (2) an optional binder polymer; and (3) an optional filler.

U.S. Pat. No. 5,212,008 (Malhotra et al.), the disclosure of which is totally incorporated herein by reference, discloses a recording sheet which comprises a substrate; a first coating in contact with the substrate which comprises a crosslinking agent selected from the group consisting of hexamethoxymethyl melamine, methylated melamine-formaldehyde, methylated urea-formaldehyde, cationic urea-formaldehyde, cationic polyamine-epichlorohydrin, glyoxal-urea resin, poly(aziridine), poly(acrylamide), poly(N,N-dimethyl acrylamide), acrylamide-acrylic acid copolymer, poly(2-acrylamido-2-methyl propane sulfonic acid), poly(N,N-dimethyl-3,5-dimethylene piperidinium chloride), poly (methylene-guanidine)hydrochloride, poly(ethylene imine) poly(ethylene imine)epichlorohydrin, poly(ethylene imine) ethoxylated, glutaraldehyde, and mixtures thereof; a catalyst; and a polymeric material capable of being crosslinked by the crosslinking agent and selected from the group consisting of polysaccharides having at least one hydroxy group, polysaccharides having at least one carboxy group, polysaccharides having at least one sulfate group, polysaccharides having at least one amine or amino group, polysaccharide gums, poly(alkylene oxides), vinyl polymers, and mixtures thereof; and a second coating in contact with the first coating which comprises a binder and a material selected from the group consisting of fatty imidazolines, ethosulfate quaternary compounds, dialkyl dimethyl methosulfate quaternary compounds, alkoxylated di-fatty quaternary compounds, amine oxides, amine ethoxylates, Imidazoline quaternary compounds, alkyl benzyl dimethyl quaternary compounds, poly (epiamines), and mixtures thereof.

U.S. Pat. No. 4,946,741 (Aono et al.) discloses an ink recording sheet comprising a transparent support having thereon an ink recording layer comprising a mixture of an amino group deactivated gelatin derivative and a polyalkylene oxide.

III

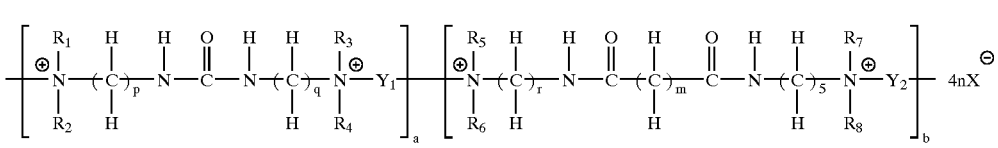

wherein a and b are each integers wherein the sum of a+b is from about 2 to about 200, $R_1$, $R_2$, $R_3$, $R_4$, $R_5$, $R_6$, $R_7$, and $R_8$ are each independently selected from the group consisting of alkyl groups, hydroxyalkyl groups, and polyoxyalkylene groups, p is an integer of from 1 to about 10, q is an integer of from 1 to about 10, X is an anion, and $Y_1$ and $Y_2$ are each independently selected from the group consisting of —$CH_2CH_2OCH_2CH_2$—, —$CH_2CH_2OCH_2CH_2OCH_2CH_2$—, —$(CH_2)_k$—, wherein k is an integer of from about 2 to about 10, and —$CH_2CH(OH)CH_2$—; (d) mixtures of U.S. Pat. No. 4,781,985 (Desjarlais) discloses an ink jet transparency which comprises a substantially transparent resinous support and a substantially clear coating thereon which includes a specific fluorosurfactant.

U.S. Pat. No. 5,073,448 (Vieira et al.) discloses a recording material for ink jet printing comprising a carrier having a surface which can be printed on or a carrier coated on one side with a material which can be printed on, wherein the carrier or the coting contains as a stabilizer at least one compound of the formula

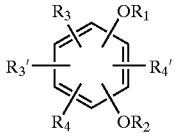

in which $R_1$ and $R_2$ independently of one another are $C_1$–$C_4$ alkyl which is unsubstituted or substituted by one or two —OH, —COO—M+and/or —$SO_3^-$M+groups, $C_3$–$C_5$ alkenyl, $C_3$–$C_5$ alkynyl,

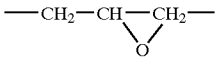

—$CH_2CH(OH)CH_2$—$SO_3$—M+, —CO-alkyl($C_1$–$C_4$) which is unsubstituted or substituted by —COOR° or —CO—N($R_5$)($R_6$) or, if $OR_1$ and $OR_2$ are in the ortho position relative to one another, $R_1$ and $R_2$ together are $C_1$–$C_6$ alkylene, M+being H+, a monovalent, divalent or trivalent metal cation or a group ($R_{12}$')N+($R_{12}$")($R_{13}$')($R_{14}$'), wherein $R_{12}$', $R_{12}$", $R_{13}$ and $R_{14}$ independently of one another are H, $C_1$–$C_4$ alkyl which is unsubstituted or substituted by 1 or 3 OH, $C_1$–$C_4$ alkyl interrupted by O, allyl, cyclopentyl, cyclohexyl, phenyl, benzyl or tolyl, or $R_1$ is a group

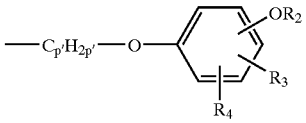

in which p' is a number from 2 to 6, $R_5$ and $R_6$ independently of one another are H or $C_1$–$C_4$ alkyl which is unsubstituted or substituted by an OH, COOR°, —COO—M+, $SO_3$—M+, P(O)(O—M+)$_2$ or P(O)(OR°)$_2$ group, $R_3$' and $R_4$' independently of one another are H, $C_1$–$C_4$ alkyl, OH or $C_1$–$C_4$ alkoxy, $R_3$ and $R_4$ independently of one another are H, halogen, —$OR_7$, —COOR°, —COO—M+, —OOC—$R_5$, —CO—N($R_5$)($R_6$), —($R_5$)N—CO—$R_6$, —CO—$R_5$, —$SO_3$—M+, —$SO_2$N($R_5$)($R_6$), P($OR_5$)$_3$, —(O)P—(O—M+)$_2$, —(O)P—(OR°)$_2$, $C_1$–$C_8$ alkyl which is unsubstituted or substituted by 1 to 7 —$OR_5$ or —OO—C—$R_5$ groups, by 1 or 2 —COOR°, —COO—M+, or —CO—N($R_5$)($R_6$) groups or by one or two —$SO_3$—M+, —$SO_2$N($R_5$)($R_6$) or —(O)P—(OR°)$_2$ or —(O)P(O—M+)$_2$ groups, where M+, $R_5$ and $R_6$ are as defined above, or $C_5$–$C_6$ cycloalkyl or allyl, R° being $C_1$–$C_4$ alkyl which is unsubstituted or substituted by an —OH group or —($CH_2CH_2O$)$_r$—H in which r is 1 to 12, and $R_7$ being $C_1$–$C_4$ alkyl or —CO-alkyl($C_1$–$C_4$) each of which is unsubstituted or substituted by 1 or 2 —OH groups or $R_3$ and $R_4$ independently of one another are one of the groups

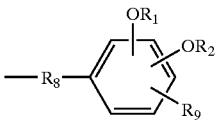

-continued

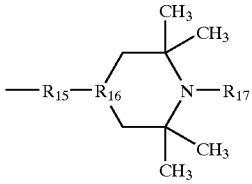

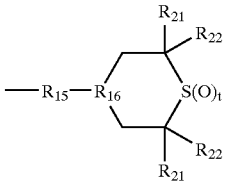

in which $R_8$ is a direct bond or methylene, $R_9$ is H, $C_1$–$C_8$ alkyl, —COO—M+ or —$SO_3$—M+, where M+, $R_1$ and $R_2$ are as defined above, $R_{15}$ is —CO—, —(O)$_g$—$C_pH_{2p}$—CO—, —OOC—$C_pH_{2p}$—, —COO—$C_pH_{2p}$—, —O—$CH_2CH(OH)$—$CH_2$— or

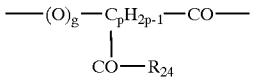

in which g is 0 or 1 and p is 1 to 6 and $R_{24}$ is —$OR_5$, —N($R_5$)($R_6$) or a group

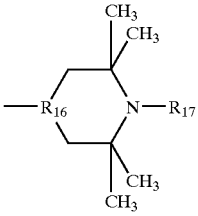

and $R_{16}$ is one of the following radicals:

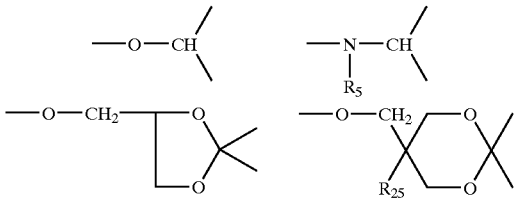

in which $R_{25}$ is H or $C_1$–$C_4$ alkyl, $R_{17}$ is H, $C_1$–$C_4$ alkyl which is unsubstituted or substituted by an —OH group, —$CH_2$—CH(OH)—$CH_2$—OH, $C_1$–$C_4$ alkoxy, —OH, —CO-alkyl($C_1$–$C_4$), —COCH=$CH_2$, allyl, benzyl or a group

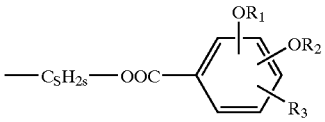

in which s is the number 2 or 3, t is a number from 0 to 2 and $R_{21}$ and $R_{22}$ independently of one another are H, $C_1$–$C_4$ alkyl or phenyl.

South African Patent Application 924,610 discloses a transparent recording sheet suitable for making visual transparencies which comprises a thin transparent film backing bearing on at least one major surface thereof an ink jet receptive layer comprising from 1% to 10% of at least one acid having a pKa of from 2 to 6, said acid being selected from the group consisting of aryl monocarboxylic acids, aryloxy monocarboxylic acids, alkyl carboxylic acids having alkyl groups containing at least 11 carbon atoms, dicarboxylic acids, tricarboxylic acids, and pyridinium salts, and at least one liquid-absorbent polymer comprising from 90% to 99% aprotic constituents, wherein said sheet shows reduced fading when imaged with an ink containing triarylmethane dye and at least one nucleophile over an identical composition containing no protic organic-solvent-soluble additive.

U.S. Pat. No. 5,220,346 (Carreira et al.), the disclosure of which is totally incorporated herein by reference, discloses a printing process which comprises applying in imagewise fashion to a substrate an ink composition which comprises an aqueous liquid vehicle, a colorant, and an ionic compound at least partially ionizable in the liquid vehicle, said ink composition having a conductivity of at least about 10 milliSiemens per centimeter, and subsequently exposing the substrate to microwave radiation, thereby drying the images on the substrate. A specific embodiment of the invention is directed to a thermal ink jet printing process which comprises (1) incorporating into a thermal ink jet printing apparatus an ink composition which comprises an aqueous liquid vehicle, a colorant, and an ionic compound at least-partially ionizable in the liquid vehicle, said ink composition having a conductivity of at least about 10 milliSiemens per centimeter; (2) heating the ink in an imagewise pattern to cause bubbles to form therein, thereby causing droplets of the ink to be ejected in an imagewise pattern onto a substrate, thereby generating images on the substrate; and (3) exposing the substrate to microwave radiation, thereby drying the images on the substrate.

Copending application U.S. Ser. No. 08/034,917, with the named inventors Shadi L. Malhotra, Brent S. Bryant, and Doris K. Weiss, filed Mar. 19, 1993, entitled "Recording Sheets Containing Phosphonium Compounds," now U.S. Pat. No. 5,760,809, the disclosure of which is totally incorporated herein by reference, discloses a recording sheet which comprises a base sheet, a phosphonium compound, an optional pigment, and an optional binder. In a preferred embodiment, the phosphonium compound is selected from the group consisting of

I

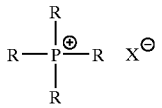

wherein R is an alkyl group, X is an anion, and all four R groups are the same;

II

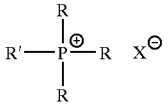

wherein R is an alkyl group, wherein all three R groups are the same, wherein R is not the same as R', X is an anion, and R' is selected from the group consisting of alkyl groups, substituted alkyl groups, arylalkyl groups, and substituted arylalkyl groups;

III

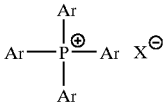

wherein Ar is an aryl group or a substituted aryl group, X is an anion, and all four Ar groups are the same;

IV

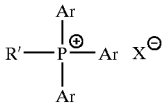

wherein Ar is an aryl group or a substituted aryl group, wherein all three Ar groups are the same, X is an anion, and R' is selected from the group consisting of alkyl groups, substituted alkyl groups, arylalkyl groups, and substituted arylalkyl groups; and mixtures thereof.

Copending application U.S. Ser. No. 08/034,943, with the named inventors Shadi L. Malhotra and Brent S. Bryant, filed Mar. 19, 1993, entitled "Recording Sheets Containing Cationic Sulfur Compounds," now U.S. Pat. No. 5,314,747, the disclosure of which is totally incorporated herein by reference, discloses a recording sheet which comprises (a) a base sheet; (b) a cationic sulfur compound selected from the group consisting of sulfonium compounds, thiazolium compounds, benzothiazolium compounds, and mixtures thereof; (c) an optional binder; and (d) an optional pigment.

Copending application U.S. Ser. No. 08/033,917, with the named inventors Shadi L. Malhotra and Brent S. Bryant, filed Mar. 19, 1993 entitled "Recording Sheets Containing Pyridinium Compounds," now U.S. Pat. No. 5,441,795, the disclosure of which is totally incorporated herein by reference, discloses a recording sheet which comprises a base sheet and a material selected from the group consisting of pyridinium compounds, piperazinium compounds, and mixtures thereof.

Copending application U.S. Ser. No. 08/034,445, with the named inventors Shadi L. Malhotra, Brent S. Bryant, and Doris K. Weiss, filed Mar. 19, 1993, entitled "Recording Sheets Containing Monoammonium Compounds," now U.S. Pat. No. 5,320,902, the disclosure of which is totally incorporated herein by reference, discloses a recording sheet which consists essentially of a substrate and, in contact with the substrate, a monoammonium compound of the formula:

I

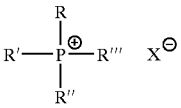

wherein R is an alkyl group, X is selected from the group consisting of fluoride, chloride, bromide, iodide, and astatide, and R', R", and R"' are each independently selected from the group consisting of alkyl groups, substituted alkyl groups, aryl groups, substituted aryl groups, arylalkyl groups, and substituted arylalkyl groups, wherein R, R', R" and R"' are either the same as or different from each other; and mixtures thereof; an optional binder component; and an optional filler component.

Copending application U.S. Ser. No. 08/033,918, with the named inventors Shadi L. Malhotra, Brent S. Bryant, and Doris K. Weiss, filed Mar. 19, 1993, entitled "Recording Sheets Containing Tetrazolium, Indolinium, and Imidazolinium Compounds," now U.S. Pat. No. 5,457,489, the disclosure of which is totally incorporated herein by reference, discloses a recording sheet which comprises (a) a base sheet; (b) a material selected from the group consisting of tetrazolium compounds, indolinium compounds, imidazolinium compounds, and mixtures thereof; (c) an optional pigment; and (d) an optional binder.

Copending application U.S. Ser. No. 08/196,669, with the named inventors Shadi L. Malhotra, Kurt B. Gundlach, and Richard L. Colt, filed concurrently herewith, entitled "Recording Sheets for Printing Processes Using Microwave Drying," now U.S. Pat. No. 5,500,668, the disclosure of which is totally incorporated herein by reference, discloses a printing process which comprises (a) providing a recording sheet which comprises a substrate, at least one monomeric salt, an optional binder, an optional antistatic agent, an optional biocide, and an optional filler; (b) applying an aqueous recording liquid to the recording sheet in an imagewise pattern; and (c) thereafter exposing the substrate to microwave radiation, thereby drying the recording liquid on the recording sheet.

Copending application U.S. Ser. No. 08/196,922 which was abandoned in favor of Ser. No. 08/444,477 which has been abandoned, with the named inventor Shadi L. Malhotra, filed concurrently herewith, entitled "Recording Sheets Containing Alcohols and Saccharides," the disclosure of which is totally incorporated herein by reference, discloses a recording sheet which comprises a substrate and a material selected from the group consisting of monosaccharides, oligosaccharides, and mixtures thereof. Another embodiment of the present invention is directed to a printing process which comprises (a) providing a recording sheet which comprises a substrate, a material selected from the group consisting of monomeric alcohols, monosaccharides, oligosaccharides, and mixtures thereof, an optional binder, an optional antistatic agent, an optional biocide, and an optional filler; (b) applying an aqueous recording liquid to the recording sheet in an imagewise pattern; and (c) thereafter exposing the substrate to microwave radiation, thereby drying the recording liquid on the recording sheet.

Copending application U.S. Ser. No. 08/196,679 with the named inventor Shadi L. Malhotra, filed concurrently herewith, entitled "Recording Sheets Containing Amino Acids, Hydroxy Acids, and Polycarboxyl Compounds," now U.S. Pat. No. 5,580,277, the disclosure of which is totally incorporated herein by reference, discloses a recording sheet which comprises a paper substrate and a material selected from the group consisting of monomeric amino acids, monomeric hydroxy acids, monomeric polycarboxyl compounds, and mixtures thereof. Another embodiment of the present invention is directed to a recording sheet which comprises a substrate and an additive material selected from the group consisting of monomeric amino acids, monomeric hydroxy acids, and mixtures thereof.

Copending application U.S. Ser. No. 08/196,607 with the named inventor Shadi L. Malhotra, filed concurrently herewith, entitled "Recording Sheets Containing Amine Salts and Quaternary Choline Halides," now U.S. Pat. No. 5,759,701, the disclosure of which is totally incorporated herein by reference, discloses a recording sheet which comprises a substrate and a material selected from the group consisting of monomeric amine acid salts, monomeric quaternary choline halides, and mixtures thereof.

Copending application U.S. Ser. No. 08/196,676, with the named inventor Shadi L. Malhotra, filed concurrently herewith, entitled "Recording Sheets Containing Pyrrole, Pyrrolidine, Pyridine, Piperidine, Homopiperidine, Quinoline, Isoquinoline, Quinuclidine, Indole, and Indazole Compounds," now U.S. Pat. No. 6,482,503, the disclosure of which is totally incorporated herein by reference, discloses a recording sheet which comprises a substrate and an additive material selected from the group consisting of pyrrole compounds, pyrrolidine compounds, pyridine compounds, piperidine compounds, homopiperidine compounds, quinoline compounds, isoquinoline compounds, quinuclidine compounds, indole compounds, indazole compounds, and mixtures thereof.

Copending application U.S. Ser. No. 08/196,672 with the named inventor Shadi L. Malhotra, filed concurrently herewith, entitled "Recording Sheets Containing Oxazole, Isooxazole, Oxazolidinone, Oxazoline Salt, Morpholine, Thiazole, Thiazolidine, Thiadiazole, and Phenothiazine Compounds," now U.S. Pat. No. 6,180,238, the disclosure of which is totally incorporated herein by reference, discloses a recording sheet which comprises a substrate and a material selected from the group consisting of oxazole compounds, isooxazole compounds, oxazolidinone compounds, oxazoline salt compounds, morpholine compounds, thiazole compounds, thiazolidine compounds, thiadiazole compounds, phenothiazine compounds, and mixtures thereof. Also disclosed is a recording sheet which consists essentially of a substrate, at least one material selected from the group consisting of oxazole compounds, isooxazole compounds, oxazolidinone compounds, oxazoline salt compounds, morpholine compounds, thiazole compounds, thiazolidine compounds, thiadiazole compounds, phenothiazine compounds, and mixtures thereof, an optional binder, an optional antistatic agent, an optional biocide, and an optional filler.

Copending application U.S. Ser. No. 08/196,605, with the named inventors Shadi L. Malhotra, Brent S. Bryant, and Arthur Y. Jones, filed concurrently herewith entitled "Recording Sheets Containing Mildew Preventing Agents," now U.S. Pat. No. 5,663,004, disclosure of which is totally incorporated herein by reference, discloses a recording sheet which comprises a substrate, an image receiving coating, and a biocide.

While known compositions and processes are suitable for their intended purposes, a need remains for improved recording sheets. In addition, there is a need for improved recording sheets suitable for use in ink jet printing processes. Further, a need remains for recording sheets which exhibit rapid drying times when imaged with aqueous inks. Additionally, there is a need for recording sheets which enable precipitation of a dye from a liquid ink onto the sheet surface during printing processes. A need also remains for recording sheets which are particularly suitable for use in printing processes wherein the recorded substrates are imaged with liquid inks and dried by exposure to microwave radiation. Further, there is a need for recording sheets coated with a discontinuous, porous film. There is also a need for recording sheets which, subsequent to being imaged with an aqueous ink, exhibit reduced curling.

SUMMARY OF THE INVENTION

It is an object of the present invention to provide recording sheets with the above noted advantages.

It is another object of the present invention to provide recording sheets suitable for use in ink jet printing processes.

It is yet another object of the present invention to provide recording sheets which exhibit rapid drying times when imaged with aqueous inks.

It is still another object of the present invention to provide recording sheets which enable precipitation of a dye from a liquid ink onto the sheet surface during printing processes.

Another object of the present invention is to provide recording sheets which are particularly suitable for use in printing processes wherein the recorded substrates are imaged with liquid inks and dried by exposure to microwave radiation.

Yet another object of the present invention is to provide recording sheets coated with a discontinuous, porous film.

Still another object of the present invention is to provide recording sheets which, subsequent to being imaged with an aqueous ink, exhibit reduced curling.

These and other objects of the present invention (or specific embodiments thereof) can be achieved by providing a recording sheet which comprises a substrate and a material selected from the group consisting of purine compounds, pyrimidine compounds, benzimidazole compounds, imidazolidine compounds, urazole compounds, pyrazole compounds, triazole compounds, benzotriazole compounds, tetrazole compounds, pyrazine compounds, and mixtures thereof. Another embodiment of the present invention is directed to a recording sheet which consists essentially of a substrate, at least one material selected from the group consisting of purine compounds, pyrimidine compounds, benzimidazole compounds, imidazolidine compounds, urazole compounds, pyrazole compounds, triazole compounds, benzotriazole compounds, tetrazole compounds, pyrazine compounds, and mixtures thereof, an optional binder, an optional antistatic agent, an optional biocide, and an optional filler.

DETAILED DESCRIPTION OF THE INVENTION

The recording sheets of the present invention comprise a substrate and at least one material selected from the group consisting of purine compounds, pyrimidine compounds, benzimidazole compounds, imidazolidine compounds, urazole compounds, pyrazole compounds, triazole compounds, benzotriazole compounds, tetrazole compounds, pyrazine compounds, and mixtures thereof. Any suitable substrate can be employed. Examples include transparent materials, such as polyester, including Mylar™, available from E.I. Du Pont de Nemours & Company, Melinex™, available from Imperial Chemicals, Inc., Celanar™, available from Celanese Corporation, polyethylene naphthalates, such as Kaladex PEN Films, available from Imperial Chemicals, Inc., polycarbonates such as Lexan™, available from General Electric Company, polysulfones, such as those available from Union Carbide Corporation, polyether sulfones, such as those prepared from 4,4'-diphenyl ether, such as Udel™, available from Union Carbide Corporation, those prepared from disulfonyl chloride, such as Victrex™, available from ICI America Incorporated, those prepared from biphenylene, such as Astrel™, available from 3M Company, poly(arylene sulfones), such as those prepared from crosslinked poly (arylene ether ketone sulfones), cellulose triacetate, polyvinylchloride cellophane, polyvinyl fluoride, polyimides, and the like, with polyester such as Mylar™ being preferred in view of its availability and relatively low cost. The substrate can also be opaque, including opaque plastics, such as Teslin™, available from PPG Industries, and filled polymers, such as Melinex®, available from ICI. Filled plastics can also be employed as the substrate, particularly when it is desired to make a "never-tear paper" recording sheet. Paper is also suitable, including plain papers such as Xerox® 4024, diazo papers, or the like.

In one embodiment of the present invention, the substrate comprises sized blends of hardwood kraft and softwood kraft fibers containing from about 10 to 90 percent by weight soft wood and from about 10 to about 90 percent by weight hardwood. Examples of hardwood include Seagull W dry bleached hardwood kraft, present in one embodiment in an amount of about 70 percent by weight. Examples of softwood include La Tuque dry bleached softwood kraft, present in one embodiment in an amount of about 30 percent by weight. These substrates can also contain fillers and pigments in any effective amounts, typically from about 1 to about 60 percent by weight, such as clay (available from Georgia Kaolin Company, Astro-fil 90 clay, Engelhard Ansilex clay), titanium dioxide (available from Tioxide Company—Anatase grade AHR), calcium silicate CH427-97-8, XP-974 (J.M. Huber Corporation), and the like. The sized substrates can also contain sizing chemicals in any effective amount, typically from about 0.25 percent to about 25 percent by weight of pulp, such as acidic sizing, including Mon size (available from Monsanto Company), alkaline sizing such as Hercon-76 (available from Hercules Company), Alum (available from Allied Chemicals as Iron free alum), retention aid (available from Allied Colloids as Percol 292), and the like. The preferred internal sizing degree of papers selected for the present invention, including commercially available papers, varies from about 0.4 to about 5,000 seconds, and papers in the sizing range of from about 0.4 to about 300 seconds are more preferred, primarily to decrease costs. Preferably, the selected substrate is porous, and the porosity value of the selected substrate preferably varies from about 100 to about 1,260 milliliters per minute and preferably from about 50 to about 600 milliliters per minute to enhance the effectiveness of the recording sheet in ink jet processes. Preferred basis weights for the substrate are from about 40 to about 400 grams per square meter, although the basis weight can be outside of this range.

Illustrative examples of commercially available internally and externally (surface) sized substrates suitable for the present invention include Diazo papers, offset papers, such as Great Lakes offset, recycled papers, such as Conservatree, office papers, such as Automimeo, Eddy liquid toner paper and copy papers available from companies such as Nekoosa, Champion, Wiggins Teape, Kymmene, Modo, Domtar, Veitsiluoto and Sanyo, and the like, with Xerox® 4024™ papers and sized calcium silicate-clay filled papers being particularly preferred in view of their availability, reliability, and low print through. Pigmented filled plastics, such as Teslin (available from PPG industries), are also preferred as supporting substrates.

The substrate can be of any effective thickness. Typical thicknesses for the substrate are from about 50 to about 500 microns, and preferably from about 100 to about 125 microns, although the thickness can be outside these ranges.

Situated on the substrate of the present invention is a material selected from the group consisting of purine compounds, pyrimidine compounds, benzimidazole compounds, imidazolidine compounds, urazole compounds, pyrazole compounds, triazole compounds, benzotriazole compounds, tetrazole compounds, pyrazine compounds, and mixtures thereof.

Purine compounds are of the general formula

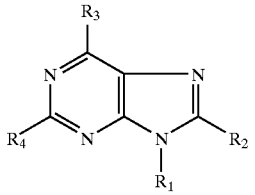

wherein $R_1$, $R_2$, $R_3$, and $R_4$ each, independently of one another, can be (but are not limited to hydrogen, alkyl, substituted alkyl (such as alkyl hydroxyl or the like), monosaccharide, oligosaccharide, hydroxyl, amine, imine, halide, mercapto, alkoxy, oxo, furfuryl amino, or the like. Other variations are also possible, however, such as wherein substituents are bonded to one or more of the nitrogen atoms in the six-membered ring and the double bonds are rearranged, and/or wherein one of the ring carbon atoms has a double bond to another atom, such as carbon, oxygen, or nitrogen, or the like.

Examples of suitable purine compounds include (1) purine (Aldrich P5,580-5), of the formula:

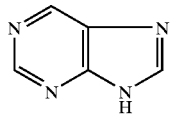

(2) 6-amino purine (adenine) (Aldrich 10,496-5), of the formula:

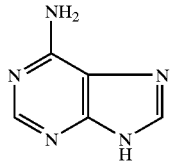

(3) 6-methoxy purine hemihydrate (Aldrich 85,270-8), of the formula:

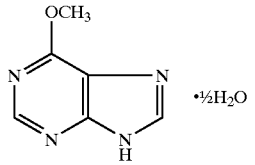

(4) 6-mercaptopurine monohydrate (Aldrich 85,267-8), of the formula:

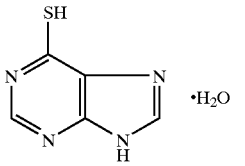

(5) 2-amino-6-chloropurine (Aldrich 10,978-9), of the formula:

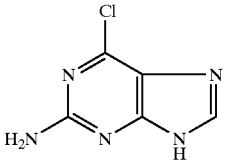

(6) 2-amino-6,8-dihydroxy purine (Aldrich 12,291-2), of the formula:

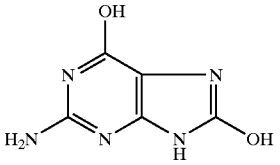

(7) theophylline (3,7 dihydro-1,3-dimethyl-1H-purine-2,6-dione) (Aldrich 26,140-8), of the formula:

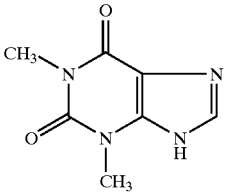

(8) kinetin (6-furfuryl amino purine) (Aldrich 85,264-3), of the formula:

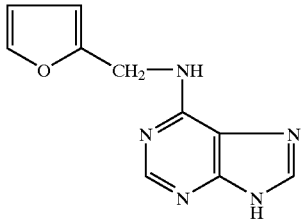

(9) 1-methyl adenine (Aldrich 21,532-5), of the formula:

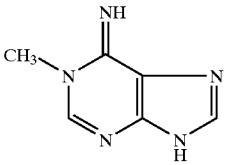

(10) 3-methyl adenine (Aldrich 28,087-9), of the formula:

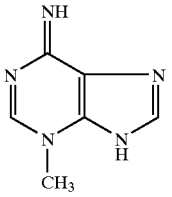

(11) (−)-adenosine (Aldrich 14,659-5), of the formula:

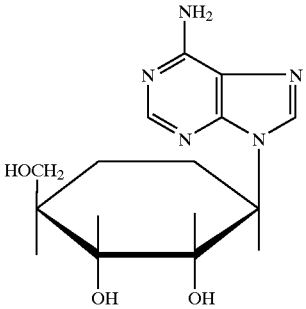

(12) (−)-inosine (Aldrich I-640-7), of the formula:

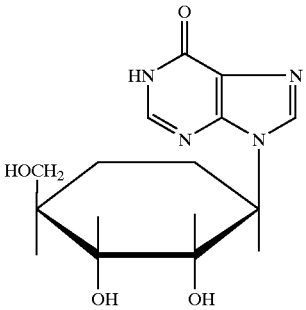

(13) 6-mercaptopurine riboside (Aldrich 85,268-6), of the formula:

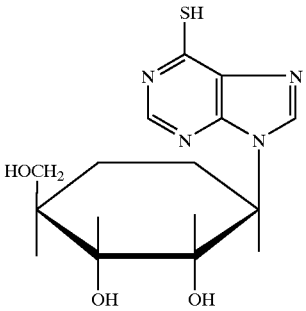

and the like.

Included within the class of purine compounds are purine salt compounds, which are of the same general formula as purine compounds except that they are associated with compounds of the formula $xH_nY^{n-}$, wherein n is an integer of 1, 2, or 3, x is a number indicating the relative ratio between pyrrole or pyrrolidine and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, or the like, as well as mixtures thereof.

Examples of suitable purine salt compounds include (1) 6-amino purine hydrochloride hemihydrate (Aldrich 27,193-4), of the formula:

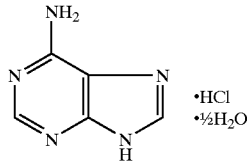

(2) 6-amino purine sulfate (Aldrich 14,581-5), of the formula:

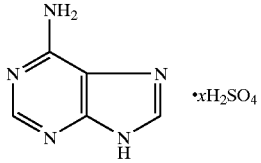

(3) 2,6-diamino-8-purinol hemisulfate monohydrate (Aldrich 11,187-2), of the formula:

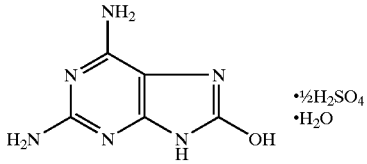

and the like.

Pyrimidine compounds are those of the general formula

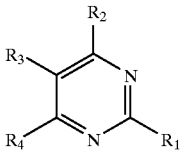

wherein $R_1$, $R_2$, $R_3$, and $R_4$ each, independently of one another, can be (but are not limited to) hydrogen, alkyl, substituted alkyl (such as hydroxy alkyl, or the like), halide, nitro, hydroxyl, amino, nitroso, mercaptyl, thio, sulfanilamide, carboxyl, oxo, monosaccharide, oligosaccharide, or the like. Other variations are also possible, such as wherein one or more of the ring double bonds is saturated, and/or wherein one or both of the ring nitrogen atoms is bonded to a substituent, and/or wherein one or more of the ring carbon atoms has a double bond to another atom such as carbon, oxygen, or sulfur, or wherein two or more substituents are joined together to form another ring, or the like.

Examples of suitable pyrimidine compounds include (a) amino pyrimidines, such as (1) 2-amino pyrimidine (Aldrich A7,860-8), of the formula:

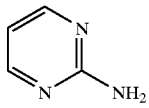

(2) 2-amino-4-methyl pyrimidine (Aldrich A6,570-0), of the formula:

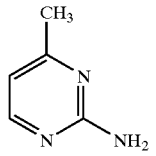

(3) 2-amino-5-nitropyrimidine (Aldrich A7,083-6), of the formula:

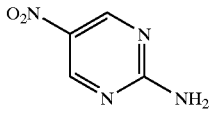

(4) 2-amino-5-bromopyrimidine (Aldrich 30,352-6), of the formula:

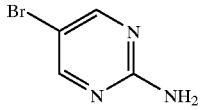

(5) 2-amino-4-chloro-6-methyl pyrimidine (Aldrich A4,600-5), of the formula:

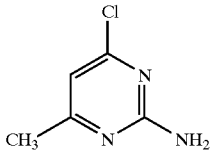

6) 2-amino-4,6-dimethyl pyrimidine (Aldrich A5,200-5), of the formula:

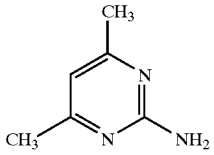

(7) 2-amino-4-hydroxy-6-methyl pyrimidine (Aldrich A5,800-3), of the formula:

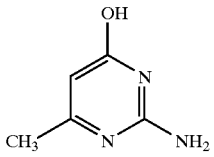

(8) 2-amino-4,6-dichloropyrimidine (Aldrich A4,860-1), of the formula:

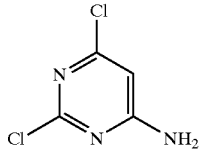

(9) 2-amino-5-bromo-6-methyl-4-pyrimidinol (Aldrich 20,520-6), of the formula:

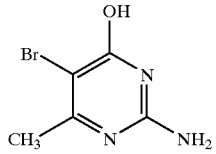

(10) 4-aminopyrimidine (Aldrich 26,182-3), of the formula:

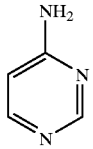

(11) 4,5-diamino pyrimidine (Aldrich D2,450-1), of the formula:

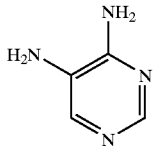

(12) 4-amino-2,6-dimethyl pyrimidine (Aldrich 18,675-9), of the formula:

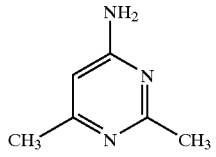

(13) 2,4-diamino-6-hydroxypyrimidine (Aldrich D1,920-6), of the formula:

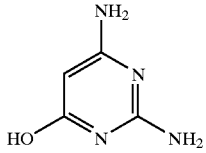

(14) 2,6-diamino-4-chloro pyrimidine (Aldrich C3,320-4), of the formula:

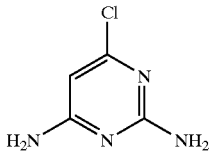

(15) 4,6-diamino-2-mercaptopyrimidine hemihydrate (Aldrich 12,580-3), of the formula:

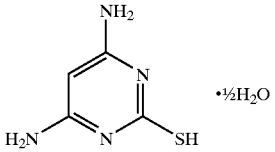

(16) 2,4,6-triamino pyrimidine (Aldrich T4,580-2), of the formula:

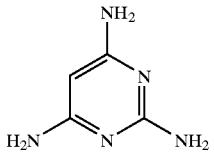

(17) 5-nitroso-2,4,6-triamino pyrimidine (Aldrich 19,420-4), of the formula:

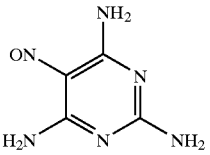

and the like.

Also suitable are (b) hydroxy pyrimidines, such as (1) 4,6-dihydroxy pyrimidine (Aldrich D12,040-5), of the formula:

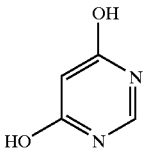

(2) 4,6-dihydroxy-2-amino pyrimidine (Aldrich A5,040-1), of the formula:

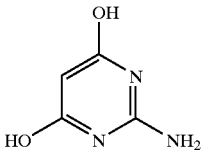

(3) 4,6-dihydroxy-2-methyl pyrimidine (Aldrich D11,525-8), of the formula:

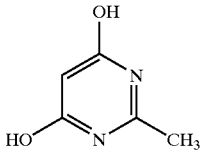

(4) 4,6-dihydroxy-5-nitropyrimidine (Aldrich 12,623-3), of the formula:

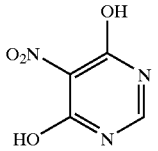

(5) 2,4dihydroxy-5-methyl pyrimidine (Aldrich 13,199-7), of the formula:

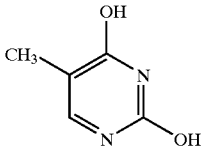

(6) 2,4-dihydroxy-6-methyl pyrimidine (Aldrich D11,520-7), of the formula:

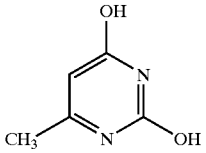

(7) 2,4-dihydroxy-5,6-dimethyl pyrimidine (Aldrich 16,536-0), of the formula:

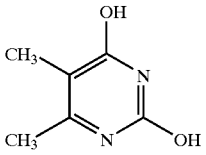

(8) 2,6-dihydroxy pyrimidine-5-carboxylic acid hydrate (Aldrich 27,770-3), of the formula:

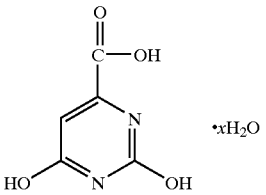

(9) 2,6-dihydroxy-4-amino pyrimidine (Aldrich A5,060-1), of the formula:

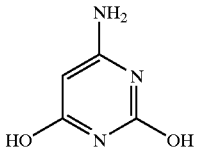

(10) 2,4,5-trihydroxy pyrimidine (Aldrich T6,670-2), of the formula:

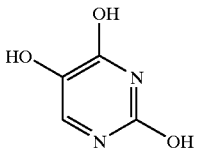

and the like.

Also suitable are (c) pyrimidine dione compounds, of the general formula

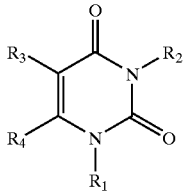

wherein $R_1$, $R_2$, $R_3$, and $R_4$ each, independently of one another, can be (but are not limited to) hydrogen, alkyl, substituted alkyl (such as hydroxy alkyl, or the like), halide, nitro, hydroxyl, amino, nitroso, mercaptyl, thio, sulfanilamide, carboxyl, oxo, monosaccharide, oligosaccharide, or the like. Other variations are also possible, such as hydrogenation of the ring double bond, or the like. Examples of suitable pyrimidine dione compounds include (1) 2,4 (1H,3H)-pyrimidine dione (uracil) (Aldrich 13,078-8), of the formula:

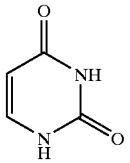

(2) 5-amino uracil (Aldrich 85,528-6), of the formula:

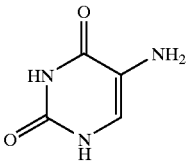

(3) 5-nitrouracil (Aldrich 85,276-7), of the formula:

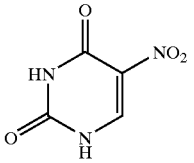

(4) 5-iodouracil (Aldrich 85,785-8), of the formula:

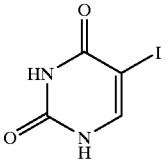

(5) 5-(hydroxymethyl)uracil hydrate (Aldrich 85,258-9), of the formula:

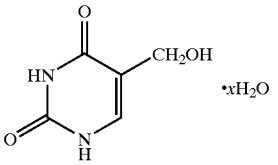

(6) 5,6-dihydrouracil (Aldrich 21,964-9), of the formula:

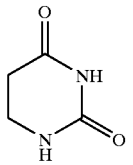

(7) 6-amino-1-methyl uracil (Aldrich 34,679-9), of the formula:

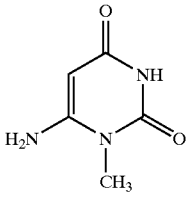

(8) 5,6-diamino-1,3-dimethyl uracil hydrate (Aldrich D,1590-1), of the formula:

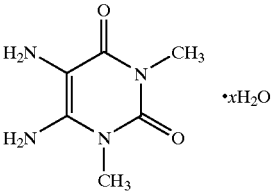

(9) uridine (Aldrich U288-1), of the formula:

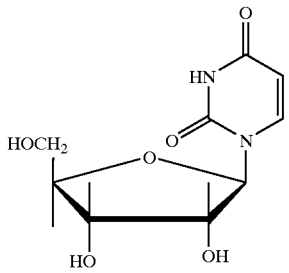

(10) 5-methyl uridine (Aldrich 28,669-9), of the formula:

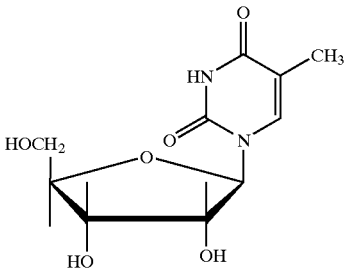

(11) 5-iodouridine (Aldrich 85,259-7), of the formula:

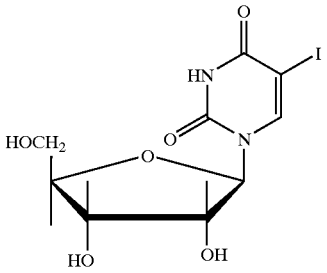

(12) thiamidine (Aldrich 85,500-6), of the formula:

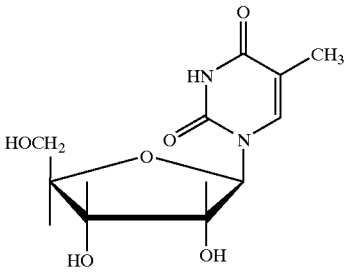

and the like.

Also suitable are (d) thiouracil compounds, such as (1) 2-thiouracil[4-hydroxy-2-mercaptopyrimidine] (Aldrich 11,588-4), of the formula:

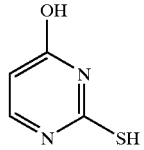

(2) 5-methyl-2-thiouracil (Aldrich 23,346-3), of the formula:

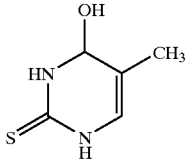

(3) 6-amino-5-nitroso-2-thiouracil (Aldrich 86,055-7), of the formula:

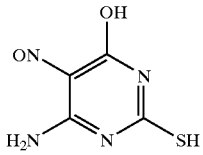

(4) 4-thiouridine (Aldrich 28,729-6), of the formula:

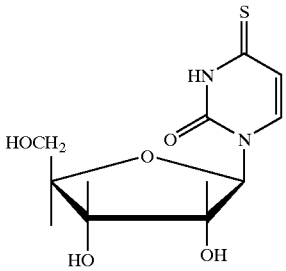

(5) 2-thiocytidine dihydrate (Aldrich 86,083-2), of the formula:

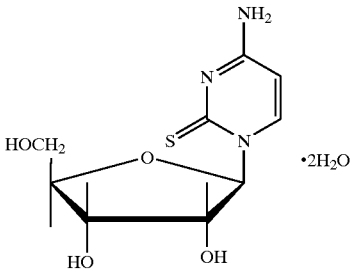

and the like.

Also suitable are (e) orotic acid compounds, such as (1) orotic acid monohydrate (Aldrich 0-840-2), of the formula:

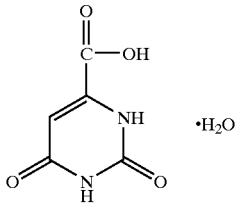

(2) L-hydroorotic acid (Aldrich 28,559-5), of the formula:

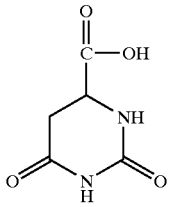

(3) 5-aminoorotic acid (Aldrich 19,121-3), of the formula:

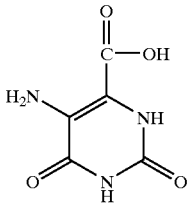

(4) methylorotate (orotic acid methyl ester) (Aldrich 22,478-2), of the formula:

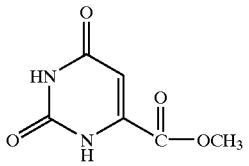

and the like.

Also suitable are (f) pyrimidine trione compounds, such as (1) barbituric acid (Aldrich B20-8), of the formula:

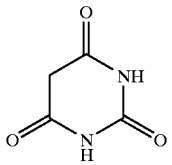

(2) 5-nitrobarbituric acid trihydrate (Aldrich N1,070-5), of the formula:

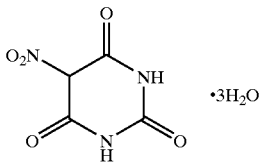

(3) violuric acid monohydrate (Aldrich 26,083-5), of the formula:

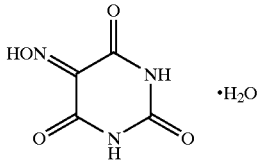

(4) alloxan monohydrate [2,4,5,6-(1H,3H)-pyrimidinetetrone] (Aldrich 23,437-0), of the formula:

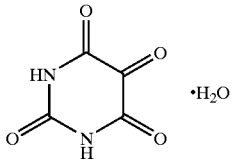

(5) 1-methyl uric acid (Aldrich 36,023-6), of the formula:

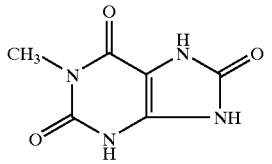

and the like.

Also suitable are (g) guanine compounds, including (1) guanine (Aldrich G1,195-0), of the formula:

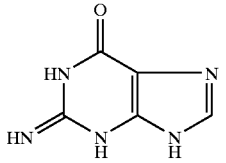

(2) guanosine hydrate (Aldrich G1,200-0), of the formula:

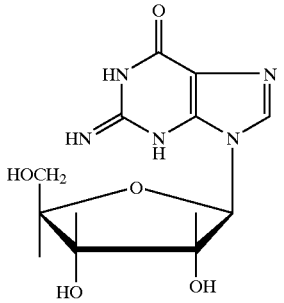

and the like.

Also suitable are (h) xanthine compounds, including (1) xanthine (Aldrich 10,954-1), of the formula:

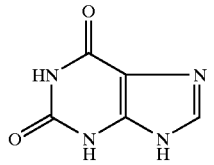

(2) 1-methylxanthine (Aldrich 28,098-4), of the formula:

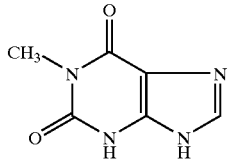

(3) 3-methyl xanthine (Aldrich 22,252-6), of the formula:

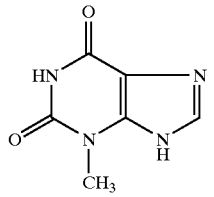

(4) 3-isobutyl-1-methyl xanthine (Aldrich 85,845-5), of the formula:

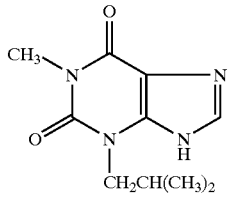

(5) hypoxanthine (Aldrich H6,120-0), of the formula:

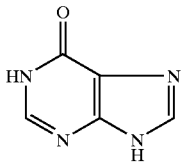

(6) xanthosine dihydrate (Aldrich 22,334-4), of the formula:

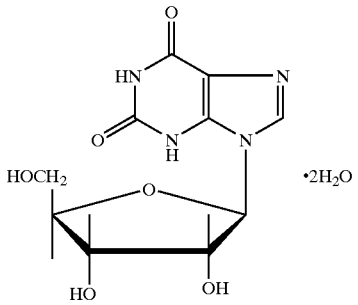

(7) 6-thioxanthene (Aldrich 85,257-0), of the formula:

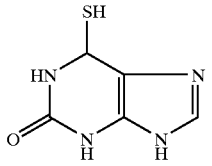

and the like.

Also suitable are (i) pyrazole pyrimidines, including (1) 4-hydroxypyrazolo[3,4-d]pyrimidine (Aldrich H5,660-6), of the formula:

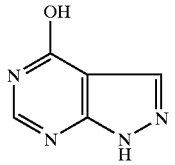

(2) 4mercapto-1H-pyrazolo-[3,4-d]-pyrimidine (Aldrich 15,306-0), of the formula:

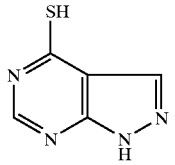

and the like.

Also suitable are (j) pyrimidine acids and their salts, including (1) folic acid dihydrate (Aldrich 23,587-3), of the formula:

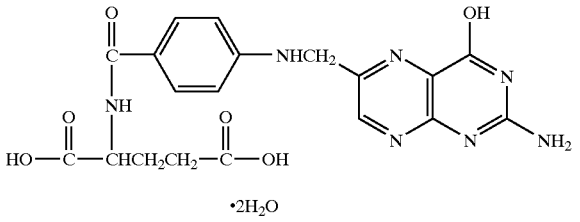

(2) folinic acid, calcium salt hydrate (Aldrich 86,189-8), of the formula:

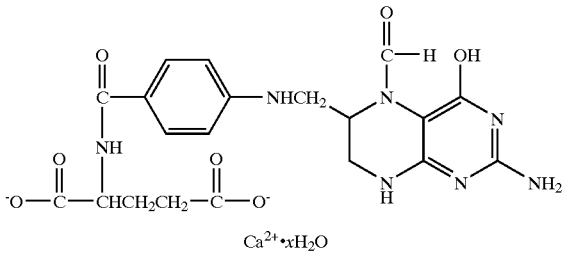

and the like.

Included within the class of pyrimidine compounds are pyrimidine salt compounds, which are of the same general formula as pyrimidine compounds except that they are associated with compounds of the formula $xH_nY^{n-}$, wherein n is an integer of 1, 2, or 3, x is a number indicating the relative ratio between pyrrole or pyrrolidine and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, or the like, as well as mixtures thereof.

Examples of suitable pyrimidine salt compounds include (1) 2-hydroxypyrimidine hydrochloride (Aldrich H5,740-8), of the formula:

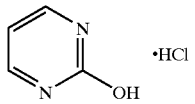

(2) 2-hydroxy-4-methyl pyrimidine hydrochloride (Aldrich H4,320-2), of the formula:

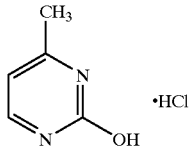

(3) 4,6-dimethyl-2-hydroxypyrimidine hydrochloride (Aldrich 33,996-2), of the formula:

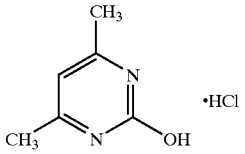

(4) 2-mercapto-4-methyl pyrimidine hydrochloride (Aldrich M480-5), of the formula:

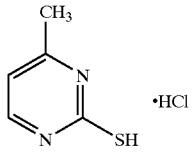

(5) 4,6-diamino pyrimidine hemisulfate monohydrate (Aldrich D2,480-3), of the formula:

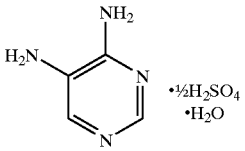

(6) 4,5,6-triamino pyrimidine sulfate hydrate (Aldrich T4,600-0; 30,718-1), of the formula:

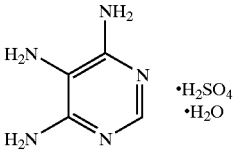

(7) 4,5-diamino-6-hydroxy pyrimidine sulfate (Aldrich D1,930-3), of the formula:

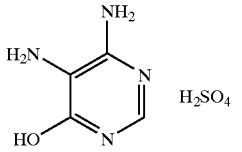

(8) 2,4-diamino-6-mercapto pyrimidine hemisulfate (Aldrich D1,996-6), of the formula:

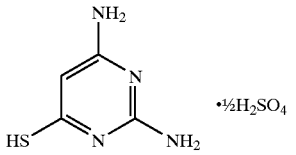

(9) 2,4-diamino-6-hydroxy pyrimidine hemisulfate hydrate (Aldrich 30,231-7), of the formula:

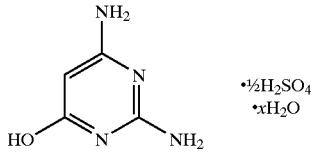

(10) 6-hydroxy-2,4,5-triamino pyrimidine sulfate (Aldrich H5,920-6), of the formula:

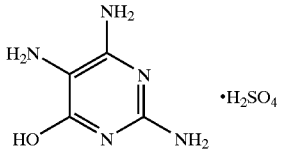

(11) 5,6-diamino-2,4-dihydroxy pyrimidine sulfate (Aldrich D1,510-3), of the formula:

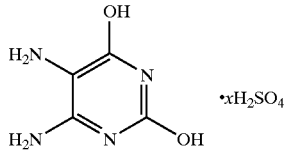

(12) $N^4$-(2-amino-4-pyrimidinyl) sulfanilamide monohydrochloride (Aldrich 15,237-4), of the formula:

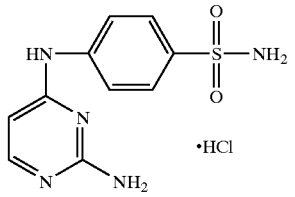

(13) 4,5,6-triamino-2(1H)-pyrimidinethione sulfate (Aldrich 26,096-7), of the formula:

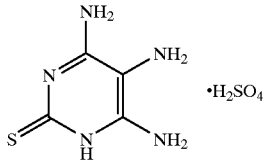

(14) 2,4,5,6-tetraamino pyrimidine sulfate (Aldrich T380-7), of the formula:

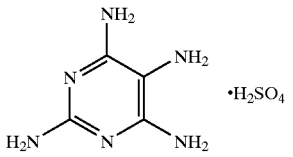

(15) (−)-cyclocytidine hydrochloride (Aldrich 85,883-8), of the formula:

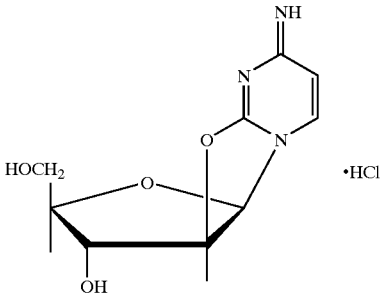

(16) cytosine arabinoside hydrochloride (Aldrich 85,585-5), of the formula:

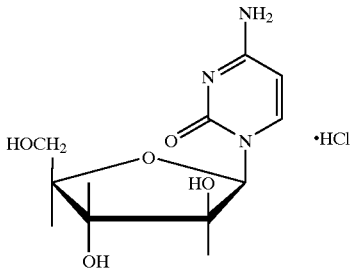

and the like.

Benzimidazole compounds are those of the general formula

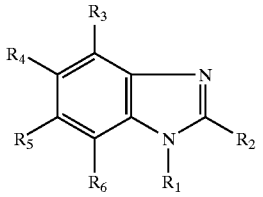

wherein $R_1$, $R_2$, $R_3$, $R_4$, $R_5$, and $R_6$ each, independently of one another, can be (but are not limited to) hydrogen, alkyl, substituted alkyl, hydroxyl, carboxyl, guanidyl, oxo, piperidine, or the like.

Examples of suitable benzimidazole compounds include (1) benzimidazole (Aldrich, 11,669-6), of the formula:

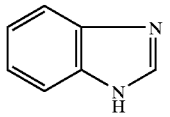

(2) 2-aminobenzimidazole (Aldrich 17,177-8), of the formula:

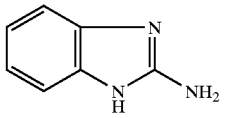

(3) 2-amino-5,6-dimethlybenzimidazole (Aldrich A5,120-3), of the formula:

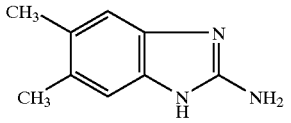

(4) 5-benzimidazole carboxylic acid (Aldrich 29,678-3), of the formula:

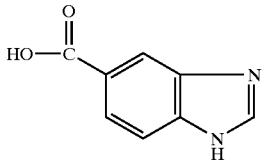

(5) 2,4,5-trimethyl benzimidazole (Aldrich T7,400-4), of the formula:

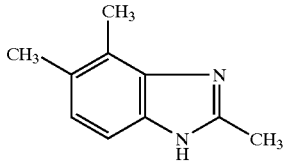

(6) 2-guanidinobenzimidazole (Aldrich G1,180-2), of the formula:

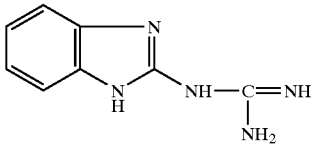

(7) 2-hydroxybenzimidazole (Aldrich H1,985-9), of the formula:

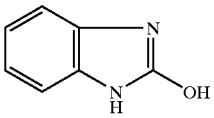

(8) 4-(2-keto-1-benzimidazolinyl)piperidine (Aldrich 12,955-0), of the formula:

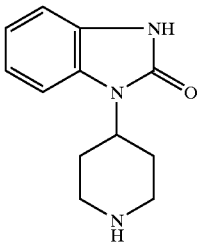

and the like.

Imidazolidine compounds are of the general formula

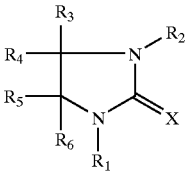

wherein $R_1$, $R_2$, $R_3$, $R_4$, $R_5$, and $R_6$ each, independently of one another, can be (but are not limited to) hydrogen, alkyl, substituted alkyl (such as alkyl carboxyl or the like), oxo, amino, amide, amino amide, carboxyl, or the like and X is oxygen, sulfur, or nitrogen (imino). Other variations are also possible, such as wherein one or more of the ring carbon atoms has a double bond to another atom such as carbon, oxygen, or sulfur, or the like.

Examples of suitable imidazolidine compounds include (1) 2-imidazolidine thione (Aldrich I-50-4), of the formula:

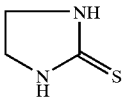

(2) 2-imidazolidone (Aldrich I-60-1), of the formula:

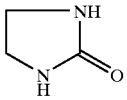

(3) hydantoin (Aldrich 15,631-1), of the formula:

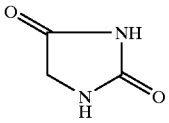

(4) 1-methyl hydantoin (Aldrich M4,988-7), of the formula:

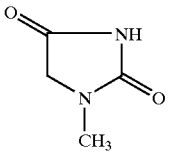

(5) creatinine (Aldrich 85,970-2), of the formula:

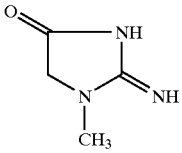

(6) 2-thiohydrantoin (Aldrich T3,040-6), of the formula:

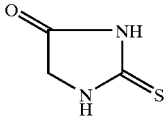

(7) 5-hydantoin acetic acid (Aldrich 85,062-4), of the formula:

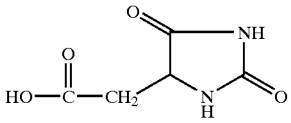

(8) 5-ureidohydantoin (allantoin) (Aldrich A2,839-2), of the formula:

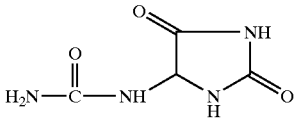

(9) 5,5-dimethyl hydantoin (Aldrich D16,140-3), of the formula:

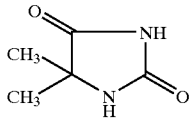

(10) 2-imidazolidone-4-carboxylic acid (Aldrich 8,6016-6), of the formula:

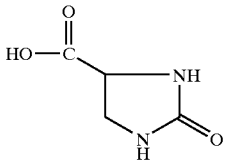

and the like.

Urazole compounds are of the general formulae

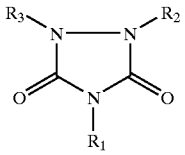

and

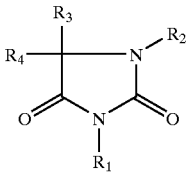

wherein $R_1$, $R_2$, $R_3$, and $R_4$ each, independently of one another, can be (but are not limited to) hydrogen, alkyl, substituted alkyl, aryl (such as phenyl or the like), substituted aryl (such as phenol or the like), arylalkyl, substituted arylalkyl, or the like.

Examples of suitable urazole compounds include (1) urazole (Aldrich U 260-1), of the formula:

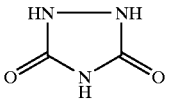

(2) 1-methyl urazole (Aldrich 27,619-7), of the formula:

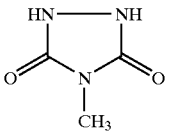

(3) 4-phenyl urazole (Aldrich 18,895-6), of the formula:

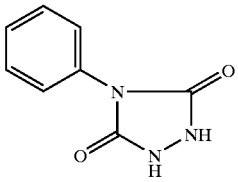

(4) D,L-5-(4-hydroxyphenyl)-5-phenyl hydantoin (Aldrich 16,154-3), of the formula:

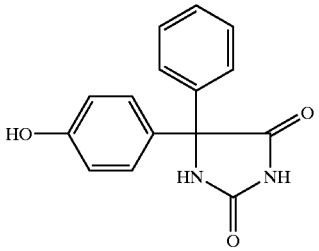

(5) β-tetralone hydantoin (Aldrich B635-2), of the formula:

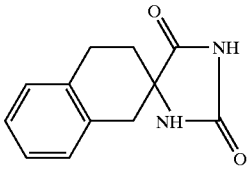

and the like.

Pyrazole compounds are of the general formula

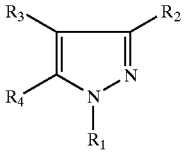

wherein $R_1$, $R_2$, $R_3$, and $R_4$ each, independently of one another, can be (but are not limited to) hydrogen, alkyl, substituted alkyl (such as hydroxy alkyl or the like), amide, hydroxyl, amino, carboxyl, ester, nitrile, alkoxy, halide, carboxamidinyl, or the like.

Examples of suitable pyrazole compounds include (1) pyrazole (Aldrich P5,660-7), of the formula:

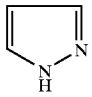

(2) 4-pyrazole carboxylic acid (Aldrich 30,071-3), of the formula:

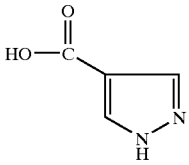

(3) ethyl 4-pyrazole carboxylate (Aldrich 30,078-0), of the formula:

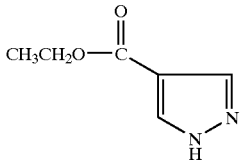

(4) 3,5-pyrazole dicarboxylic acid monohydrate (Aldrich P5,680-1), of the formula:

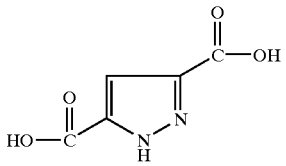

amino pyrazole compounds, such as (5) 3-amino pyrazole (Aldrich 16,064-4), of the formula:

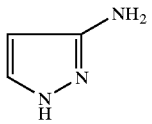

(6) 3-amino-5-hydroxypyrazole (Aldrich 33,144-9), of the formula:

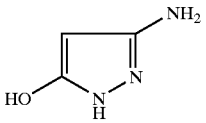

(7) 3-amino-5-methylpyrazole (Aldrich 34,020-0), of the formula:

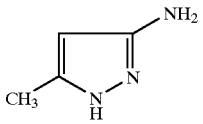

(8) 3-amino-4-pyrazole carbonitrile (Aldrich 15,304-4), of the formula:

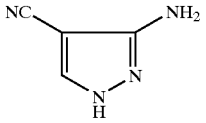

(9) 3-amino-4-pyrzaolecarboxylic acid (Aldrich A7,740-7), of the formula:

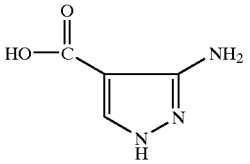

(10) 3-amino-4-carbethoxypyrazole (Aldrich A4,500-9), of the formula:

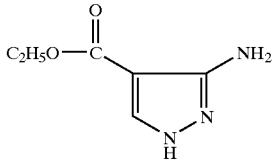

(11) 5-amino-1-ethylpyrazole (Aldrich 29,576-0), of the formula:

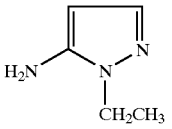

methyl pyrazole compounds and dimethyl pyrazole compounds, such as (12) 4-bromo-3-methyl pyrazole (Aldrich 27,823-8), of the formula:

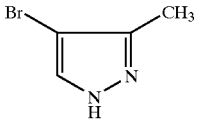

(13) 3,5-dimethyl pyrazole (Aldrich D18,200-1), of the formula:

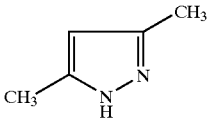

(14) 3,5-dimethyl pyrazole-1-carboxamide (Aldrich D18, 220-6), of the formula:

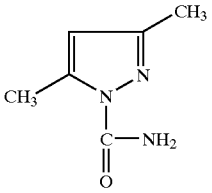

(15) 4-bromo-3,5-dimethyl pyrazole (Aldrich B6,440-7), of the formula:

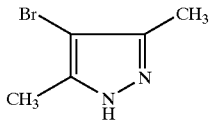

(16) 3,5-dimethylpyrazole-1-methanol (Aldrich 33,145-7), of the formula:

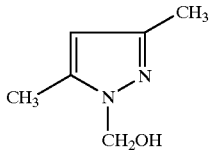

and the like.

The class of pyrazole compounds includes pyrazole salts, which are of the same general formula as pyrazole compounds except that they are associated with compounds of the formula $xH_nY^{n-}$, wherein n is an integer of 1, 2, or 3, x is a number indicating the relative ratio between pyrrole or pyrrolidine and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, or the like, as well as mixtures thereof.

Examples of suitable pyrazole salt compounds include (1) 4-methyl pyrazole hydrochloride (Aldrich 28,667-2)

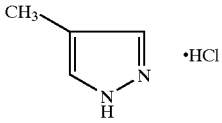

(2) 3,4-diamino-5-hydroxy pyrazole sulfate (Aldrich D1,900-1)

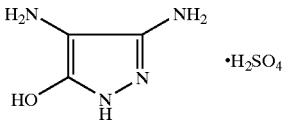

(3) (3,5-dimethyl pyrazole-1-carboxamidine nitrate) (Aldrich D18,225-7)

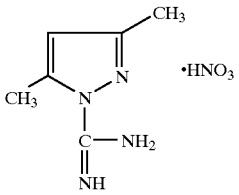

(4) 3-amino-4-pyrazole carboxamide hemisulfate (Aldrich 15,305-2)

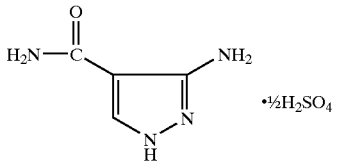

(5) acid salt of 6-amino indazole hydrochloride (Aldrich A5, 955-7)

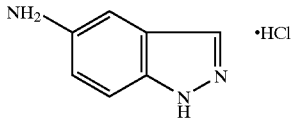

and the like.

Triazole compounds are of the general formulae

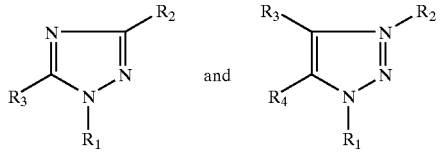

wherein $R_1$, $R_2$, and $R_3$ each, independently of one another, can be (but are not limited to) hydrogen, alkyl, substituted alkyl (such as mercapto alkyl or the like), amino, mercaptyl, carboxyl, hydrazinyl, aryl, substituted aryl, or the like.

Examples of suitable triazole compounds include (1) 1,2,4-triazole (Aldrich T4,610-8), of the formula:

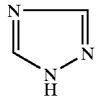

(2) 1,2,4-triazole sodium derivative (Aldrich 19,764-5), of the formula:

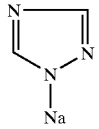

(3) 3-amino-1,2,4-triazole (Aldrich A8,160-9), of the formula:

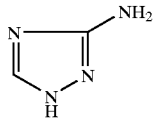

(4) 4-amino-1,2,4-triazole (Aldrich A8,180-3), of the formula:

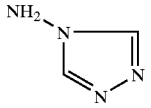

(5) 3,5-diamino-1,2,4-triazole (Aldrich D2,620-2), of the formula:

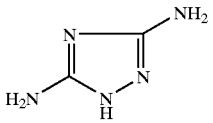

(6) 3-amino-5-mercapto-1,2,4-triazole (Aldrich 14,026-0), of the formula:

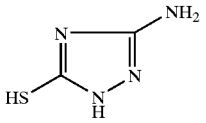

(7) 3-amino-5-methylthio-lH-1,2,4-triazole (Aldrich 19,068-3), of the formula:

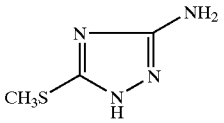

(8) 3-amino-1,2,4-triazole-5-carboxylic acid hemihydrate (Aldrich 28,207-3), of the formula:

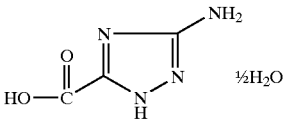

(9) 4-amino-3-hydrazino-5-mercapto-1,2,4-triazole (Aldrich 16,289-3), of the formula:

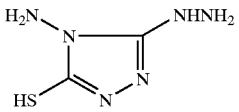

(10) 1,2,3-triazole-4,5-dicarboxylic acid monohydrate (Aldrich 26,972-7), of the formula:

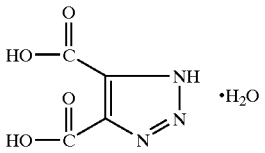

(11) nitron [4,5-dihydro-2,4-diphenyl-5-(phenylimino)-1H-1,2,4-triazolium hydroxide inner salt] (Aldrich 24,326-4), of the formula:

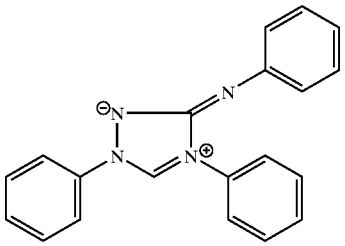

and the like.

Benzotriazole compounds are of the general formula

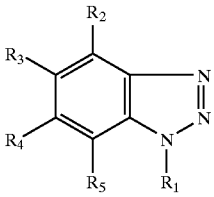

wherein $R_1$, $R_2$, $R_3$, and $R_4$ each, independently of one another, can be (but are not limited to) hydrogen, alkyl, substituted alkyl, hydroxyl, or the like.

Examples of suitable benzotriazole compounds include (1) benzotriazole (Aldrich B1,140-0), of the formula:

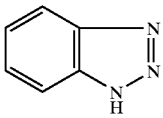

(2) 1-hydroxybenzotriazole hydrate (Aldrich 15,726-0), of the formula:

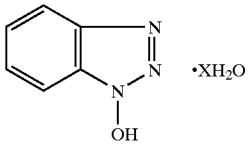

and the like.

Tetrazole compounds are of the general formula

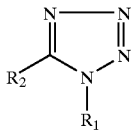

wherein $R_1$ and $R_2$ each, independently of one another, can be (but are not limited to) hydrogen, alkyl, substituted alkyl, amine, or the like.

Examples of suitable tetrazole compounds include (1) 1-H-tetrazole (Aldrich 15,569-1), of the formula:

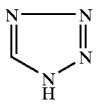

(2) 5-amino tetrazole monohydrate (Aldrich A8,060-2), of the formula:

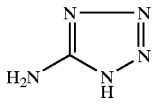

and the like.

Pyrazine compounds are of the general formula

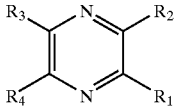

wherein $R_1$, $R_2$, $R_3$, and $R_4$ each, independently of one another, can be (but are not limited to) hydrogen, alkyl, substituted alkyl, carboxyl, amide, hydroxyl, amine, or the like. Other variations are also possible, such as when two or more substituents are joined together to form another ring, or the like.

Examples of suitable pyrazine compounds include (1) 5-methyl-2-pyrazine carboxylic acid (Aldrich 34,764-7), of the formula:

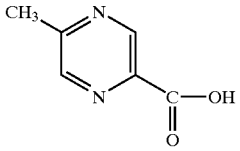

(2) pyrazine amide (Aldrich 13,157-1), of the formula:

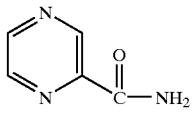

(3) 2,3-pyrazine dicarboxamide (Aldrich P5,615-1), of the formula:

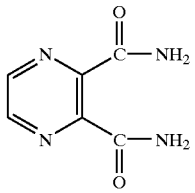

(4) 4-pyridazine carboxylic acid (Aldrich 29,776-3), of the formula:

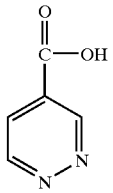

(5) 2,3-pyrazine dicarboxylic acid (Aldrich P5,620-8), of the formula:

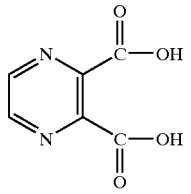

(6) lumazine monohydrate (Aldrich L330-7), of the formula:

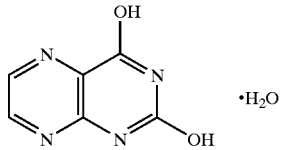

(7) xanthopterin monohydrate (Aldrich X70-8), of the formula:

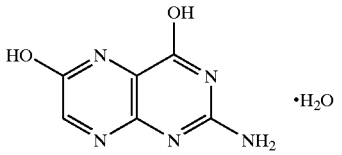

(8) 2-quinoxazoline carboxylic acid (Aldrich 29,340-7), of the formula:

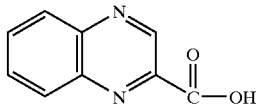

(9) 2-quinoxalinol (Aldrich 26,051-7), of the formula:

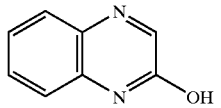

(10) 2,3-dihydroxy quinoxaline (Aldrich 14,478-9), of the formula:

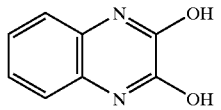

(11) phenazine methosulfate (Kodak 1360155, available from Eastman Kodak Co.), of the formula:

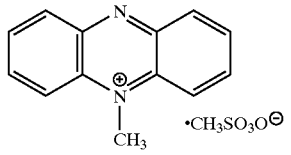

and the like.

Mixtures of any two or more of the above materials can also be employed.

The purine compound, pyrimidine compound, benzimidazole compound, imidazolidine compound, urazole compound, pyrazole compound, triazole compound, benzotriazole compound, tetrazole compound, pyrazine compound, or mixture thereof is present in any effective amount relative to the substrate. Typically, the purine compound, pyrimidine compound, benzimidazole compound, imidazolidine compound, urazole compound, pyrazole compound, triazole compound, benzotriazole compound, tetrazole compound, pyrazine compound, or mixture thereof is present in an amount of from about 1 to about 50 percent by weight of the substrate, preferably from about 5 to about 30 percent by weight of the substrate, although the amount can be outside this range. The amount can also be expressed in terms of the weight of purine compound, pyrimidine compound, benzimidazole compound, imidazolidine compound, urazole compound, pyrazole compound, triazole compound, benzotriazole compound, tetrazole compound, pyrazine compound, or mixture thereof per unit area of substrate. Typically, the purine compound, pyrimidine compound, benzimidazole compound, imidazolidine compound, urazole compound, pyrazole compound, triazole compound, benzotriazole compound, tetrazole compound, pyrazine compound, or mixture thereof is present in an amount of from about 0.8 to about 40 grams per square meter of the substrate surface to which it is applied, and preferably from about 4 to about 24 grams per square meter of the substrate surface to which it is applied, although the amount can be outside these ranges.

When the purine compound, pyrimidine compound, benzimidazole compound, imidazolidine compound, urazole compound, pyrazole compound, triazole compound, benzotriazole compound, tetrazole compound, pyrazine compound, or mixture thereof is applied to the substrate as a coating, the coatings employed for the recording sheets of the present invention can include an optional binder in addition to the purine compound, pyrimidine compound, benzimidazole compound, imidazolidine compound, urazole compound, pyrazole compound, triazole compound, benzotriazole compound, tetrazole compound, pyrazine compound, or mixture thereof. Examples of suitable binder polymers include (a) hydrophilic polysaccharides and their modifications, such as (1) starch (such as starch SLS-280, available from St. Lawrence starch), (2) cationic starch (such as Cato-72, available from National Starch), (3) hydroxyalkylstarch, wherein alkyl has at least one carbon atom and wherein the number of carbon atoms is such that the material is water soluble, preferably from about 1 to about 20 carbon atoms, and more preferably from about 1 to about 10 carbon atoms, such as methyl, ethyl, propyl, butyl, or the like (such as hydroxypropyl starch (#02382, available from Poly Sciences Inc.) and hydroxyethyl starch (#06733, available from Poly Sciences Inc.)), (4) gelatin (such as Calfskin gelatin #00639, available from Poly Sciences Inc.), (5) alkyl celluloses and aryl celluloses, wherein alkyl has at least one carbon atom and wherein the number of carbon atoms is such that the material is water soluble, preferably from 1 to about 20 carbon atoms, more preferably from 1 to about 10 carbon atoms, and even more preferably from 1 to about 7 carbon atoms, such as methyl, ethyl, propyl, butyl, pentyl, hexyl, benzyl, and the like (such as methyl cellulose (Methocel AM 4, available from Dow Chemical Company)), and wherein aryl has at least 6 carbon atoms and wherein the number of carbon atoms is such that the material is water soluble, preferably from 6 to about 20 carbon atoms, more preferably from 6 to about 10 carbon atoms, and even more preferably about 6 carbon atoms, such as phenyl, (6) hydroxy alkyl celluloses, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like (such as hydroxyethyl cellulose (Natrosol 250 LR, available from Hercules Chemical Company), and hydroxypropyl cellulose (Klucel Type E, available from Hercules Chemical Company)), (7) alkyl hydroxy alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like (such as ethyl hydroxyethyl cellulose (Bermocoll, available from Berol Kem. A. B. Sweden)), (8) hydroxy alkyl alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as hydroxyethyl methyl cellulose (HEM, available from British Celanese Ltd., also available as Tylose M H, MHK from Kalle A. G.), hydroxypropyl methyl cellulose (Methocel K35LV, available from Dow Chemical Company), and hydroxy butylmethyl cellulose (such as HBMC, available from Dow Chemical Company)), (9) dihydroxyalkyl cellulose, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as dihydroxypropyl cellulose, which can be prepared by the reaction of 3-chloro-1,2-propane with alkali cellulose), (10) hydroxy alkyl hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as hydroxypropyl hydroxyethyl cellulose, available from Aqualon Company), (11) halodeoxycellulose, wherein halo represents a halogen atom (such as chlorodeoxycellulose, which can be prepared by the reaction of cellulose with sulfuryl chloride in pyridine at 25° C.), (12) amino deoxycellulose (which can be prepared by the reaction of chlorodeoxy cellulose with 19 percent alcoholic solution of ammonia for 6 hours at 160° C.), (13) dialkylammonium halide hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom (such as diethylammonium chloride hydroxy ethyl cellulose, available as Celquat H-100, L-200, National Starch and Chemical Company), (14) hydroxyalkyl trialkyl ammonium halide hydroxyalkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom (such as hydroxypropyl trimethyl ammonium chloride hydroxyethyl cellulose, available from Union Carbide Company as Polymer JR), (15) dialkyl amino alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, (such as diethyl amino ethyl cellulose, available from Poly Sciences Inc. as DEAE cellulose #05178), (16) carboxyalkyl dextrans, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, and the like, (such as carboxymethyl dextrans, available from Poly Sciences Inc. as #16058), (17) dialkyl aminoalkyl dextran, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as diethyl aminoethyl dextran, available from Poly Sciences Inc. as #5178), (18) amino dextran (available from Molecular Probes Inc), (19) carboxy alkyl cellulose salts, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like (such as sodium carboxymethyl cellulose CMC 7HOF, available from Hercules Chemical Company), (20) gum arabic (such as #G9752, available from Sigma Chemical Company), (21) carrageenan (such as #C1013 available from Sigma Chemical Company), (22) Karaya gum (such as #G0503, available from Sigma Chemical Company), (23) xanthan (such as Keltrol-T, available from Kelco division of Merck and Company), (24) chitosan (such as #C3646, available from Sigma Chemical Company), (25) carboxyalkyl hydroxyalkyl guar, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as carboxymethyl hydroxypropyl guar, available from Auqualon Company), (26) cationic guar (such as Celanese Jaguars C-14-S, C-15, C-17, available from Celanese Chemical Company), (27) n-carboxyalkyl chitin, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as n-carboxymethyl chitin, (28) dialkyl ammonium hydrolyzed collagen protein, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as dimethyl ammonium hydrolyzed collagen protein, available from Croda as Croquats), (29) agar-agar (such as that available from Pfaltz and Bauer Inc), (30) cellulose sulfate salts, wherein the cation is any conventional cation, such as sodium, lithium, potassium, calcium, magnesium, or the like (such as sodium cellulose sulfate #023 available from Scientific Polymer Products), and (31) carboxyalkylhydroxyalkyl cellulose salts, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like (such as sodium carboxymethylhydroxyethyl cellulose CMHEC 43H and 37L available from Hercules Chemical Company); (b) vinyl polymers, such as (1) poly(vinyl alcohol) (such as Elvanol available from Dupont Chemical Company), (2) poly(vinyl phosphate) (such as #4391 available from Poly Sciences Inc.), (3) poly(vinyl pyrrolidone) (such as that available from GAF Corporation), (4) vinyl pyrrolidone-vinyl acetate copolymers (such as #02587, available from Poly Sciences Inc.), (5) vinyl pyrrolidone-styrene copolymers (such as #371, available from Scientific Polymer Products), (6) poly (vinylamine) (such as #1562, available from Poly Sciences Inc.), (7) poly(vinyl alcohol) alkoxylated, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as poly(vinyl alcohol) ethoxylated #6573, available from Poly Sciences Inc.), and (8) poly(vinyl pyrrolidone-dialkylaminoalkyl alkylacrylate), wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as poly(vinyl pyrrolidone-diethylaminomethylmethacrylate) #16294 and #16295, available from Poly Sciences Inc.); (c) formaldehyde resins, such as (1) melamine-formaldehyde resin (such as BC 309, available from British Industrial Plastics Limited), (2) urea-formaldehyde resin (such as BC777, available from British Industrial Plastics Limited), and (3) alkylated urea-formaldehyde resins, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as methylated urea-formaldehyde resins, available from American Cyanamid Company as Beetle 65); (d) ionic polymers, such as (1) poly(2-acrylamide-2-methyl propane sulfonic acid) (such as #175 available from Scientific Polymer Products), (2) poly(N,N-dimethyl-3,5-dimethylene piperidinium chloride) (such as #401, available from Scientific Polymer Products), and (3) poly(methylene-guanidine) hydrochloride (such as #654, available from Scientific Polymer Products); (e) latex polymers, such as (1) cationic, anionic, and nonionic styrene-butadiene latexes (such as that available from Gen Corp Polymer Products, such as RES 4040 and RES 4100, available from Unocal Chemicals, and such as DL 6672A, DL6638A, and DL6663A, available from Dow Chemical Company), (2) ethylene-vinylacetate latex (such as Airflex 400, available from Air Products and Chemicals Inc.), (3) vinyl acetate-acrylic copolymer latexes (such as synthemul 97-726, available from Reichhold Chemical Inc, Resyn 25-1110 and Resyn 25-1140, available from National Starch Company, and RES 3103 available from Unocal Chemicals, (4) quaternary acrylic copolymer latexes, particularly those of the formula

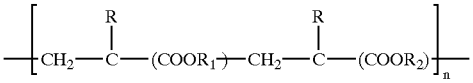

wherein n is a n umber of from about 10 to about 100, and preferably about 50, R is hydrogen or methyl, $R_1$ is hydrogen, an alkyl group, or an aryl group, and $R_2$ is $N^+(CH_3)_3X^-$, wherein X is an anion, such as Cl, Br, I, $HSO_3$, $SO_3$, $CH_2SO_3$, $H_2PO_4$, $HPO_4$, $PO_4$, or the like, and the degree of quaternization is from about 1 to about 100 percent, including polymers such as polymethyl acrylate trimethyl ammonium chloride latex, such as HX42-1, available from Interpolymer Corp., or the like; (f) maleic anhydride and maleic acid containing polymers, such as (1) styrene-maleic anhydride copolymers (such as that available as Scripset from Monsanto, and the SMA series available from Arco), (2) vinyl alkyl ether-maleic anhydride copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinyl methyl ether-maleic anhydride copolymer #173, available from Scientific Polymer Products), (3) alkylene-maleic anhydride copolymers, wherein alkylene has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as ethylene-maleic anhydride copolymer #2308, available from Poly Sciences Inc., also available as EMA from Monsanto Chemical Company), (4) butadiene-maleic acid copolymers (such as #07787, available from Poly Sciences Inc.), (5) vinylalkylether-maleic acid copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinylmethylether-maleic acid copolymer, available from GAF Corporationas Gantrez S-95), and (6) alkyl vinyl ether-maleic acid esters, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as methyl vinyl ether-maleic acid ester #773, available from Scientific Polymer Products); (g) acrylamide containing polymers, such as (1) poly(acrylamide) (such as #02806, available from Poly Sciences Inc.), (2) acrylamide-acrylic acid copolymers (such as #04652, #02220, and #18545, available from Poly Sciences Inc.), and (3) poly(N,N-dimethyl acrylamide) (such as #004590, available from Poly Sciences Inc.); and (h) poly (alkylene imine) containing polymers, wherein alkylene has two (ethylene), three (propylene), or four (butylene) carbon atoms, such as (1) poly(ethylene imine) (such as #135, available from Scientific Polymer Products), (2) poly (ethylene imine) epichlorohydrin (such as #634, available from Scientific Polymer Products), and (3) alkoxylated poly(ethylene imine), wherein alkyl has one (methoxylated), two (ethoxylated), three (propoxylated), or four (butoxylated) carbon atoms (such as ethoxylated poly (ethylene imine #636, available from Scientific Polymer Products); and the like, as well as blends or mixtures of any of the above, with starches and latexes being particularly preferred because of their availability and applicability to paper. Any mixtures of the above ingredients in any relative amounts can be employed.

If present, the binder can be present within the coating in any effective amount; typically the binder and the purine compound, pyrimidine compound, benzimidazole compound, imidazolidine compound, urazole compound, pyrazole compound, triazole compound, benzotriazole compound, tetrazole compound, pyrazine compound, or mixture thereof are present in relative amounts of from about 10 percent by weight binder and about 90 percent by weight purine compound, pyrimidine compound, benzimidazole compound, imidazolidine compound, urazole compound, pyrazole compound, triazole compound, benzotriazole compound, tetrazole compound, pyrazine compound, or mixture thereof to about 99 percent by weight binder and about 1 percent by weight purine compound, pyrimidine compound, benzimidazole compound, imidazolidine compound, urazole compound, pyrazole compound, triazole compound, benzotriazole compound, tetrazole compound, pyrazine compound, or mixture thereof, although the relative amounts can be outside of this range.

In addition, the coating of the recording sheets of the present invention can contain optional antistatic agents. Any suitable or desired antistatic agent or agents can be employed, such as quaternary salts and other materials as disclosed in, for example, U.S. Pat. Nos. 5,760,809; 5,314,747; 5,441,795; 5,320,902 and 5,457,486, the disclosures of each of which are totally incorporated herein by reference. The antistatic agent can be present in any effective amount; typically, the antistatic agent is present in an amount of from about 1 to about 5 percent by weight of the coating, and preferably in an amount of from about 1 to about 2 percent by weight of the coating, although the amount can be outside these ranges.

Further, the coating of the recording sheets of the present invention can contain one or more optional biocides. Examples of suitable biocides include (A) non-ionic biocides, such as (1) 2-hydroxypropylmethane thiosulfonate (Busan 1005, available from Buckman Laboratories Inc.); (2) 2-(thio cyanomethyl thio)benzothiazole (Busan 30WB, 72WB, available from Buckman Laboratories Inc.); (3) methylene bis(thiocyanate) (Metasol T-10, available from Calgon Corporation; AMA-110, available from Vinings Chemical Company; Vichem MBT, available from Vineland Chemical Company; Aldrich 10,509-0); (4) 2-bromo-4'-hydroxyacetophenone (Busan 90, available from Buckman Laboratories); (5) 1,2-dibromo-2,4-dicyanobutane (Metasol CB-210, CB-235, available from Calgon Corporation); (6) 2,2-dibromo-3-nitropropionamide (Metasol RB-20, available from Calgon Corporation; Amerstat 300, available from Drew Industrial Div.); (7) N-α-(1-nitroethyl benzylethylene diamine) (Metasol J-26, available from Calgon Corporation); (8) dichlorophene (G-4, available from Givaudan Corporation); (9) 3,5-dimethyl tetrahydro-2H-1, 3,5-thiadiazine-2-thione (SLIME-TROL RX-28, available from Betz Paper Chem Inc.; Metasol D3T-A, available from Calgon Corporation; SLIME ARREST, available from Western Chemical Company); (10) a non-ionic blend of a sulfone, such as bis (trichloromethyl) sulfone and methylene bisthiocyanate (available as SLIME-TROL RX-38A from Betz Paper Chem Inc.); (11) a non-ionic blend of methylene bisthiocyanate and bromonitrostyrene (available as SLIME-TROL RX-41 from Betz Paper Chem Inc.); (12) a non-ionic blend of 2-(thiocyanomethylthio)benzothiazole (53.2% by weight) and 2-hydroxypropyl methanethiosulfonate (46.8% by weight) (available as BUSAN 25 from Buckman Laboratories Inc.); (13) a non-ionic blend of methylene bis (thiocyanate) 50 percent by weight and 2-(thiocyanomethylthio)benzothiazole 50 percent by weight (available as BUSAN 1009, 1009WB from Buckman Laboratories Inc.); (14) a non-ionic blend of 2-bromo-4'-hydroxyacetophenone (70 percent by weight) and 2-(thiocyanomethylthio)benzothiazole (30 percent by weight) (BUSAN 93, available from Buckman Laboratories Inc.); (15) a non-ionic blend of 5-chloro-2-methyl-4-isothiazoline-3-one (75 percent by weight) and 2-methyl-4-isothiazolin-3-one (25 percent by weight), (available as AMERSTAT 250 from Drew Industrial Division; NALCON 7647, from NALCO Chemical Company;Kathon LY, from Rohm and Haas Co.); and the like, as well as mixtures thereof; (B) anionic biocides, such as (1) anionic potassium N-hydroxymethyl-N-methyl-dithiocarbamate (available as BUSAN 40 from Buckman Larboratories Inc.); (2) an anionic blend of N-hydroxymethyl-N-methyl dithiocarbamate (80% by weight) and sodium 2-mercapto benzothiazole (20% by weight) (available as BUSAN 52 from Buckman Laboratories Inc.); (3) an anionic blend of sodium dimethyl dithiocarbamate 50 percent by weight and (disodium ethylenebis-dithiocarbamate) 50% by weight (available as METASOL 300 from Calgon Corporation; AMERSTAT 272 from Drew Industrial Division; SLIME CONTROL F from Western Chemical Company); (4) an anionic blend of N-methyldithiocarbamate 60 percent by weight and disodium cyanodithioimidocarbonate 40 percent by weight (available as BUSAN 881 from Buckman Laboratories Inc); (5) An anionic blend of methylene bis-thiocyanate (33% by weight), sodium dimethyl-dithiocarbamate (33% by weight), and sodium ethylene bisdithiocarbamate (33% by weight) (available as AMERSTAT 282 from Drew Industrial Division; AMA-131 from Vinings Chemical Company); (6) sodium dichlorophene (G-4-40, available from Givaudan Corp.); and the like, as well as mixtures thereof; (C) cationic biocides, such as (1) cationic poly(oxyethylene (dimethylamino)-ethylene(dimethylamino)ethylene dichloride) (Busan 77, available from Buckman Laboratories Inc.); (2) a cationic blend of methylene bisthiocyanate and dodecyl guanidine hydrochloride (available as SLIME TROL RX-31, RX-32, RX-32P, RX-33, from Betz Paper Chem Inc.); (3) a cationic blend of a sulfone, such as bis(trichloromethyl)sulfone and a quaternary ammonium chloride (available as SLIME TROL RX-36 DPB-865 from Betz Paper Chem. Inc.); (4) a cationic blend of methylene bis thiocyanate and chlorinated phenols (available as SLIME-TROL RX-40 from Betz Paper Chem Inc.); and the like, as well as mixtures thereof. The biocide can be present in any effective amount; typically, the biocide is present in an amount of from about 10 parts per million to about 3 percent by weight of the coating, although the amount can be outside this range.

Additionally, the coating of the recording sheets of the present invention can contain optional filler components. Fillers can be present in any effective amount, and if present, typically are present in amounts of from about 1 to about 60 percent by weight of the coating composition. Examples of filler components include colloidal silicas, such as Syloid 74, available from Grace Company (preferably present, in one embodiment, in an amount of about 20 weight percent), titanium dioxide (available as Rutile or Anatase from NL Chem Canada, Inc.), hydrated alumina (Hydrad TMC-HBF, Hydrad TM-HBC, available from J.M. Huber Corporation), barium sulfate (K.C. Blanc Fix HD80, available from Kali Chemie Corporation), calcium carbonate (Microwhite Sylacauga Calcium Products), high brightness clays (such as Engelhard Paper Clays), calcium silicate (available from J.M. Huber Corporation), cellulosic materials insoluble in water or any organic solvents (such as those available from Scientific Polymer Products), blend of calcium fluoride and silica, such as Opalex-C available from Kemira.O.Y, zinc oxide, such as Zoco Fax 183, available from Zo Chem, blends of zinc sulfide with barium sulfate, such as Lithopane, available from Schteben Company, and the like, as well as mixtures thereof. Brightener fillers can enhance color mixing and assist in improving print-through in recording sheets of the present invention.

The coating containing the purine compound, pyrimidine compound, benzimidazole compound, imidazolidine compound, urazole compound, pyrazole compound, triazole compound, benzotriazole compound, tetrazole compound, pyrazine compound, or mixture thereof is present on the substrate of the recording sheet of the present invention in any effective thickness. Typically, the total thickness of the coating layer (on each side, when both surfaces of the substrate are coated) is from about 1 to about 25 microns and preferably from about 5 to about 10 microns, although the thickness can be outside of these ranges.

The purine compound, pyrimidine compound, benzimidazole compound, imidazolidine compound, urazole compound, pyrazole compound, triazole compound, benzotriazole compound, tetrazole compound, pyrazine compound, or mixture thereof or the mixture of purine compound, pyrimidine compound, benzimidazole compound, imidazolidine compound, urazole compound, pyrazole compound, triazole compound, benzotriazole compound, tetrazole compound, pyrazine compound, or mixture thereof, optional binder, optional antistatic agent, optional biocide, and/or optional filler can be applied to the substrate by any suitable technique, such as size press treatment, dip coating, reverse roll coating, extrusion coating, or the like. For example, the coating can be applied with a KRK size press (Kumagai Riki Kogyo Co., Ltd., Nerima, Tokyo, Japan) by dip coating and can be applied by solvent extrusion on a Faustel Coater. The KRK size press is a lab size press that simulates a commercial size press. This size press is normally sheet fed, whereas a commercial size press typically employs a continuous web. On the KRK size press, the substrate sheet is taped by one end to the carrier mechanism plate. The speed of the test and the roll pressures are set, and the coating solution is poured into the solution tank. A 4 liter stainless steel beaker is situated underneath for retaining the solution overflow. The coating solution is cycled once through the system (without moving the substrate sheet) to wet the surface of the rolls and then returned to the feed tank, where it is cycled a second time. While the rolls are being "wetted", the sheet is fed through the sizing rolls by pressing the carrier mechanism start button. The coated sheet is then removed from the carrier mechanism plate and is placed on a 12 inch by 40 inch sheet of 750 micron thick Teflon for support and is dried on the Dynamic Former drying drum and held under restraint to prevent shrinkage. The drying temperature is approximately 105° C. This method of coating treats both sides of the substrate simultaneously.

In dip coating, a web of the material to be coated is transported below the surface of the liquid coating composition by a single roll in such a manner that the exposed site is saturated, followed by removal of any excess coating by the squeeze rolls and drying at 100° C. in an air dryer. The liquid coating composition generally comprises the desired coating composition dissolved in a solvent such as water, methanol, or the like. The method of surface treating the substrate using a coater results in a continuous sheet of substrate with the coating material applied first to one side and then to the second side of this substrate. The substrate can also be coated by a slot extrusion process, wherein a flat die is situated with the die lips in close proximity to the web of substrate to be coated, resulting in a continuous film of the coating solution evenly distributed across one surface of the sheet, followed by drying in an air dryer at 100° C.

Recording sheets of the present invention can be employed in ink jet printing processes. One embodiment of the present invention is directed to a process which comprises applying an aqueous recording liquid to a recording sheet of the present invention in an imagewise pattern. Another embodiment of the present invention is directed to a printing process which comprises (1) incorporating into an ink jet printing apparatus containing an aqueous ink a recording sheet of the present invention, and (2) causing droplets of the ink to be ejected in an imagewise pattern onto the recording sheet, thereby generating images on the recording sheet. Ink jet printing processes are well known, and are described in, for example, U.S. Pat. Nos. 4,601,777, 4,251,824, 4,410,899, 4,412,224, and 4,532,530, the disclosures of each of which are totally incorporated herein by reference. In a particularly preferred embodiment, the printing apparatus employs a thermal ink jet process wherein the ink in the nozzles is selectively heated in an imagewise pattern, thereby causing droplets of the ink to be ejected in imagewise pattern. In another preferred embodiment, the substrate is printed with an aqueous ink and thereafter the printed substrate is exposed to microwave radiation, thereby drying the ink on the sheet. Printing processes of this nature are disclosed in, for example, U.S. Pat. No. 5,220,346, the disclosure of which is totally incorporated herein by reference.

The recording sheets of the present invention can also be used in any other printing or imaging process, such as printing with pen plotters, handwriting with ink pens, offset printing processes, or the like, provided that the ink employed to form the image is compatible with the ink receiving layer of the recording sheet.

Recording sheets of the present invention exhibit reduced curl upon being printed with aqueous inks, particularly in situations wherein the ink image is dried by exposure to microwave radiation. Generally, the term "curl" refers to the distance between the base line of the arc formed by recording sheet when viewed in cross-section across its width (or shorter dimension—for example, 8.5 inches in an 8.5×11 inch sheet, as opposed to length, or longer dimension—for example, 11 inches in an 8.5×11 inch sheet) and the midpoint of the arc. To measure curl, a sheet can be held with the thumb and forefinger in the middle of one of the long edges of the sheet (for example, in the middle of one of the 11 inch edges in an 8.5×11 inch sheet) and the arc formed by the sheet can be matched against a pre-drawn standard template curve.

Specific embodiments of the invention will now be described in detail. These examples are intended to be illustrative, and the invention is not limited to the materials, conditions, or process parameters set forth in these embodiments. All parts and percentages are by weight unless otherwise indicated.

The optical density measurements recited herein were obtained on a Pacific Spectrograph Color System. The system consists of two major components, an optical sensor and a data terminal. The optical sensor employs a 6 inch integrating sphere to provide diffuse illumination and 8 degrees viewing. This sensor can be used to measure both transmission and reflectance samples. When reflectance samples are measured, a specular component may be included. A high resolution, full dispersion, grating monochromator was used to scan the spectrum from 380 to 720 nanometers. The data terminal features a 12 inch CRT display, numerical keyboard for selection of operating parameters and the entry of tristimulus values, and an alphanumeric keyboard for entry of product standard information.

EXAMPLE I

Transparency sheets were prepared as follows. Blends of 70 percent by weight hydroxypropyl methyl cellulose (K35LV, obtained from Dow Chemical Co.) and 30 percent by weight of various additive compositions, each obtained from Aldrich Chemical Co., were prepared by mixing 56 grams of hydroxypropyl methyl cellulose and 24 grams of the additive composition in 1,000 milliliters of water in a 2 Liter jar and stirring the contents in an Omni homogenizer for 2 hours. Subsequently, the solution was left overnight for removal of air bubbles. The blends thus prepared were then coated by a dip coating process (both sides coated in one operation) by providing Mylar® base sheets in cut sheet form (8.5×11 inches) in a thickness of 100 microns. Subsequent to air drying at 25° C. for 3 hours followed by oven drying at 100° C. for 10 minutes and monitoring the difference in weight prior to and subsequent to coating, the dried coated sheets were each coated with 1 gram, 10 microns in thickness, on each surface (2 grams total coating weight for 2-sided transparency) of the substrate. For comparison purposes, a transparency sheet was also prepared in which the coating consisted of 100 percent by weight hydroxypropyl methyl cellulose and contained no additive composition.

The transparency sheets thus prepared were incorporated into a Hewlett-Packard 500-C color ink jet printer containing inks of the following compositions:

Cyan: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 30 percent by weight Projet Cyan 1 dye, obtained from ICI, 45.45 percent by weight water.

Magenta: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 2.5 percent by weight Triton Direct Red 227, obtained from Tricon, 72.95 percent by weight water.

Yellow: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 3 percent by weight Hoechst Duasyn Brilliant Yellow SF-GL VP220, obtained from Hoechst, 72.45 percent by weight water.

Images were generated by printing block patterns for magenta, cyan, yellow, and black. The images thus formed were dried by exposure to microwave radiation with a Citizen Model No. JM55581, obtained from Consumers, Mississauga, Ontario, Canada, set at 700 Watts output power at 2450 MHz frequency. The black images were "process black" (i.e., formed by superimposition of cyan, magenta, and yellow images). The drying times and optical densities for the resulting images were as follows:

| Additive | Drying Time (seconds) | | | | Optical Density | | | |
|---|---|---|---|---|---|---|---|---|
| | black | cyan | magenta | yellow | black | cyan | magenta | yellow |
| none | 30 | 20 | 30 | 20 | 2.50 | 2.07 | 1.45 | 0.99 |
| 4,6-dimethyl-2-hydroxy pyrimidine hydrochloride | 20 | 10 | 40 | 10 | 1.80 | 1.65 | 1.37 | 0.95 |
| 6-amino purine | 10 | 20 | 20 | 20 | 2.00 | 2.00 | 1.50 | 0.90 |
| 1,4-bis (2-hydroxyethyl) piperazine | 20 | 30 | 20 | 20 | 2.40 | 2.31 | 1.69 | 0.90 |
| 4-(2-hydroxyethyl)-1-piperazine propane sulfonic acid | 10 | 10 | 40 | 30 | 2.00 | 1.78 | 1.70 | 0.92 |
| 1-(2-methoxy phenyl) piperazine hydrochloride | 10 | 15 | 15 | 20 | 1.80 | 2.00 | 1.51 | 0.93 |
| 3,5-dimethyl-pyrazole-1-carboxamidine nitrate | 10 | 10 | 20 | 20 | 1.88 | 1.85 | 1.63 | 0.96 |

As the results indicate, the drying times of the process black images were faster in the presence of the additives than in their absence. In addition, the optical densities of all images were also acceptable and in some instances were improved.

EXAMPLE II

Transparency sheets were prepared as follows. Blends of 90 percent by weight hydroxypropyl methyl cellulose (K35LV, obtained from Dow Chemical Co.) and 10 percent by weight of various additive compositions, each obtained from Aldrich Chemical Co., were prepared by mixing 72 grams of hydroxypropyl methyl cellulose and 8 grams of the additive composition in 1,000 milliliters of water in a 2 Liter jar and stirring the contents in an Omni homogenizer for 2 hours. Subsequently, the solution was left overnight for removal of air bubbles. The blends thus prepared were then coated by a dip coating process (both sides coated in one operation) by providing Mylar® base sheets in cut sheet form (8.5×11 inches) in a thickness of 100 microns. Subsequent to air drying at 25° C. for 3 hours followed by oven drying at 100° C. for 10 minutes and monitoring the difference in weight prior to and subsequent to coating, the dried coated sheets were each coated with 1 gram, 10 microns in thickness, on each surface (2 grams total coating weight for 2-sided transparency) of the substrate. For comparison purposes, a transparency sheet was also prepared in which the coating consisted of 100 percent by weight hydroxypropyl methyl cellulose and contained no additive composition.

The transparency sheets thus prepared were incorporated into a Hewlett-Packard 500-C color ink jet printer containing inks of the following compositions:

Cyan: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 30 percent by weight Projet Cyan 1 dye, obtained from ICI, 45.45 percent by weight water.

Magenta: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 2.5 percent by weight Triton Direct Red 227, obtained from Tricon, 72.95 percent by weight water.

Yellow: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 3 percent by weight Hoechst Duasyn Brilliant Yellow SF-GL VP220, obtained from Hoechst, 72.45 percent by weight water.

Images were generated by printing block patterns for magenta, cyan, yellow, and black. The images thus formed were allowed to dry at 25° C. The black images were "process black" (i.e., formed by superimposition of cyan, magenta, and yellow images). The drying times and optical densities for the resulting images were as follows:

| | Drying Time (minutes) | | | | Optical Density | | | |
|---|---|---|---|---|---|---|---|---|
| Additive | black | cyan | magenta | yellow | black | cyan | magenta | yellow |
| none | 10 | 5 | 5 | 2 | 2.95 | 2.10 | 1.37 | 0.99 |
| 4,6-dimethyl-2-hydroxy pyrimidine hydrochloride | 8 | 3 | 5 | 1.5 | 1.70 | 1.70 | 1.50 | 0.80 |
| 6-amino purine (adenine) sulfate | 8 | 3 | 4 | 1.5 | 1.65 | 1.60 | 1.10 | 0.92 |
| 6-amino purine hydrochloride hemihydrate | 8 | 4 | 4 | 1.5 | 2.50 | 2.00 | 1.20 | 0.80 |
| orotic acid monohydrate | 8 | 4 | 4 | 1.5 | 2.40 | 1.81 | 0.91 | 0.77 |
| 1,4-bis (2-hydroxyethyl) piperazine | 6 | 2.5 | 2.5 | 1.5 | 1.90 | 2.37 | 1.43 | 0.82 |
| sarcosine anhydride | 7 | 2.5 | 5 | 1.5 | 2.00 | 1.79 | 1.30 | 0.90 |
| 4-(2-hydroxyethyl)-1-piperazine propane sulfonic acid | 6 | 2.5 | 2.5 | 1.5 | 1.90 | 1.90 | 1.40 | 0.82 |
| 1-(2-methoxy phenyl) piperazine hydrochloride | 6 | 3 | 3 | 1.5 | 1.88 | 1.95 | 1.45 | 0.82 |
| 1-(2-ethoxy phenyl) piperazine monohydro-chloride (methanol) | 6 | 3 | 3 | 1.5 | 1.52 | 1.80 | 1.27 | 0.87 |
| L-histidine monochloride | 7 | 3 | 3 | 2 | 2.70 | 1.75 | 1.15 | 0.85 |

As the results indicate, the drying times of the transparencies containing the additives were generally equivalent to or faster than the drying times of the transparency containing no additives. In addition, the optical densities of the images on the transparencies containing the additives were acceptable and in some instances improved compared to those on the transparencies containing no additives.

EXAMPLE III

Transparency sheets were prepared as follows. Blends of 54 percent by weight hydroxypropyl methyl cellulose (K35LV, obtained from Dow Chemical Co.), 36 percent by weight poly(ethylene oxide) (POLY OX WSRN-3000, obtained from Union Carbide Corp., and 10 percent by weight of various additive compositions, each obtained from Aldrich Chemical Co., were prepared by mixing 43.2 grams of hydroxypropyl methyl cellulose, 28.8 grams of poly (ethylene oxide), and 8 grams of the additive composition in 1,000 milliliters of water in a 2 Liter jar and stirring the contents in an Omni homogenizer for 2 hours. Subsequently, the solution was left overnight for removal of air bubbles. The blends thus prepared were then coated by a dip coating process (both sides coated in one operation) by providing Mylar® base sheets in cut sheet form (8.5×11 inches) in a thickness of 100 microns. Subsequent to air drying at 25° C. for 3 hours followed by oven drying at 100° C. for 10 minutes and monitoring the difference in weight prior to and subsequent to coating, the dried coated sheets were each coated with 1 gram, 10 microns in thickness, on each surface (2 grams total coating weight for 2-sided transparency) of the substrate. For comparison purposes, a transparency sheet was also prepared in which the coating consisted of 60 percent by weight hydroxypropyl methyl cellulose and 40 percent by weight poly(ethylene oxide) and contained no additive composition.

The transparency sheets thus prepared were incorporated into a Hewlett-Packard 500-C color ink jet printer containing inks of the following compositions:

Cyan: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 30 percent by weight Projet Cyan 1 dye, obtained from ICI, 45.45 percent by weight water.

Magenta: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 2.5 percent by weight Triton Direct Red 227, obtained from Tricon, 72.95 percent by weight water.

Yellow: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 3 percent by weight Hoechst Duasyn Brilliant Yellow SF-GL VP220, obtained from Hoechst, 72.45 percent by weight water.

Images were generated by printing block patterns for magenta, cyan, yellow, and black. The images thus formed were allowed to dry at 25° C. The black images were "process black" (i.e., formed by superimposition of cyan, magenta, and yellow images). The drying times and optical densities for the resulting images were as follows:

| | Drying Time (minutes) | | | | Optical Density | | | |
|---|---|---|---|---|---|---|---|---|
| Additive | black | cyan | magenta | yellow | black | cyan | magenta | yellow |
| none | 15 | 10 | 10 | 10 | 1.40 | 1.46 | 1.34 | 1.02 |
| 2-hydroxy pyrimidine hydrochloride | 10 | 6 | 6 | 5 | 1.40 | 1.35 | 1.20 | 0.83 |
| 4-(2-hydroxyethyl)-1-piperazine propane sulfonic acid | 10 | 6 | 5 | 4 | 1.42 | 1.40 | 1.22 | 0.82 |
| 2-methylthio-2-imidazoline hydriodide | 9 | 5 | 5 | 4 | 1.38 | 1.58 | 1.30 | 0.93 |
| urazole | 8 | 5 | 4 | 4 | 1.41 | 1.44 | 1.18 | 0.85 |

As the results indicate, the drying times of the transparencies containing the additives were generally faster than the drying times of the transparency containing no additives. In addition, the optical densities of the images on the transparencies containing the additives were acceptable in all instances.

EXAMPLE IV

Paper recording sheets were prepared as follows. Coating compositions containing various additive compositions, each obtained from Aldrich Chemical Co., were prepared by dissolving 50 grams of the additive in 500 milliliters of water in a beaker and stirring for 1 hour at 25° C. The additive solutions thus prepared were then coated onto paper by a dip coating process (both sides coated in one operation) by providing paper base sheets in cut sheet form (8.5×11 inches) in a thickness of 100 microns. Subsequent to air drying at 100° C. for 10 minutes and monitoring the difference in weight prior to and subsequent to coating, the sheets were each coated on each side with 500 milligrams, in a thickness of 5 microns (total coating weight 1 gram for two-sided sheets), of the additive composition For comparison purposes, an uncoated paper sheet treated with a composition containing only water by the same procedure was also imaged.

The paper sheets thus prepared were incorporated into a Hewlett-Packard 500-C color ink jet printer containing inks of the following composition:

Cyan: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 30 percent by weight Projet Cyan 1 dye, obtained from ICI, 45.45 percent by weight water.

Magenta: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 2.5 percent by weight Triton Direct Red 227, obtained from Tricon, 72.95 percent by weight water.

Yellow: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 3 percent by weight Hoechst Duasyn Brilliant Yellow SF-GL VP220, obtained from Hoechst, 72.45 percent by weight water.

Images were generated with 100 percent ink coverage. After the image was printed, the paper sheets were each weighed precisely in a precision balance at time zero and periodically after that. The difference in weight was recorded as a function of time, 100 minutes being considered as the maximum time required for most of the volatile ink components to evaporate. (Volatiles were considered to be ink components such as water and glycols that an evaporate, as compared to components such as dyes, salts, and/or other non-volatile components. Knowing the weight of ink deposited at time zero, the amount of volatiles in the image can be calculated.) After 1000 minutes, the curl values of the paper were measured and are listed in the Table below. The black images were "process black" (i.e., formed by superimposition of cyan, magenta, and yellow images).

| | percent weight-loss of volatiles at various times (minutes) | | | | | | 1,000 minutes | |
|---|---|---|---|---|---|---|---|---|
| Additive | 5 | 10 | 15 | 30 | 60 | 120 | wt. loss % | curl in mm |
| none | 32 | 43 | 45 | 48 | 50 | 53 | 65 | 125 |
| 2-amino pyrimidine | 41 | 54 | 58 | 64 | 66 | 68 | 100 | 5 |
| 2-hydroxy pyrimidine hydrochloride | 33 | 48 | 52 | 56 | 62 | 64 | 85 | 25 |

-continued

| Additive | percent weight-loss of volatiles at various times (minutes) 5 | 10 | 15 | 30 | 60 | 120 | 1,000 minutes wt. loss % | curl in mm |
|---|---|---|---|---|---|---|---|---|
| 4,6-dimethyl-2-hydroxy pyrimidine hydrochloride | 35 | 49 | 56 | 60 | 62 | 65 | 85 | 10 |
| 2,4,5,6-tetra amino pyrimidine sulfate | 32 | 47 | 51 | 60 | 69 | 78 | 95 | 5 |
| purine | 33 | 45 | 50 | 57 | 59 | 63 | 75 | 35 |
| 6-aminopurine hydrochloride hemihydrate | 31 | 45 | 50 | 56 | 58 | 60 | 89 | 20 |
| 1,4-bis (2-hydroxyethyl) piperazine | 33 | 52 | 57 | 64 | 65 | 66 | 91 | 25 |
| 1,4-dimethyl-2,5-piperazine dione | 40 | 49 | 53 | 56 | 59 | 66 | 83 | 35 |
| 4-(2-hydroxyethyl)-1-piperazine ethane sulfonic acid | 29 | 44 | 50 | 56 | 59 | 60 | 88 | 25 |
| 1-(4-chlorophenyl) piperazine dihydrochloride | 29 | 38 | 43 | 47 | 50 | 53 | 78 | 55 |
| 1-(2-methoxyphenyl) piperazine hydrochloride | 36 | 45 | 50 | 53 | 57 | 60 | 78 | 25 |
| 1-(0-tolyl) piperazine hydrochloride | 38 | 51 | 56 | 61 | 65 | 68 | 99 | 20 |
| 2-methylthio-2-imidazoline hydriodide | 37 | 50 | 52 | 54 | 58 | 66 | 78 | 25 |
| L-histidine monochloride monohydrate | 34 | 51 | 55 | 60 | 63 | 68 | 91 | 15 |
| urazole | 29 | 38 | 40 | 43 | 46 | 52 | 81 | 20 |
| 1-H-tetrazole | 31 | 44 | 49 | 52 | 54 | 58 | 81 | 25 |
| 3-amino pyrazole | 40 | 45 | 49 | 52 | 53 | 59 | 69 | 65 |
| 3,5-dimethyl pyrazole-1-carboxamidine nitrate | 24 | 43 | 48 | 54 | 56 | 58 | 76 | 30 |

As the results indicate, the papers coated with the additives exhibited higher weight loss of volatiles at time 1,000 minutes compared to the paper which had been treated with water alone. In addition, the papers coated with the additives exhibited lower curl values compared to the curl value for the paper treated with water alone.

EXAMPLE V

Paper recording sheets were prepared as follows. Coating compositions containing various additive compositions, each obtained from Aldrich Chemical Co., were prepared by dissolving 50 grams of the additive in 500 milliliters of water in a beaker and stirring for 1 hour at 25° C. The additive solutions thus prepared were then coated onto paper by a dip coating process (both sides coated in one operation) by providing paper base sheets in cut sheet form (8.5×11 inches) in a thickness of 100 microns. Subsequent to air drying at 100° C. for 10 minutes and monitoring the difference in weight prior to and subsequent to coating, the sheets were each coated on each side with 500 milligrams, in a thickness of 5 microns (total coating weight 1 gram for two-sided sheets), of the additive composition For comparison purposes, an uncoated paper sheet treated with a composition containing only water by the same procedure was also imaged.

The paper sheets thus prepared were incorporated into a Hewlett-Packard 500-C color ink jet printer containing inks of the following composition:

Cyan: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 30 percent by weight Projet Cyan 1 dye, obtained from ICI, 45.45 percent by weight water.

Magenta: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 2.5 percent by weight Triton Direct Red 227, obtained from Tricon, 72.95 percent by weight water.

Yellow: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 3 percent by weight Hoechst Duasyn Brilliant Yellow SF-GL VP220, obtained from Hoechst, 72.45 percent by weight water.

The black images were "process black" (i.e., formed by superimposition of cyan, magenta, and yellow images). The optical densities for the resulting images were as follows:

| Addtive | Optical Density black | cyan | magenta | yellow |
|---|---|---|---|---|
| none | 1.08 | 1.18 | 1.03 | 0.80 |
| 2-amino pyrimidine | 1.16 | 1.29 | 1.14 | 0.89 |
| 2-hydroxy pyrimidine hydrochloride | 0.99 | 1.03 | 0.80 | 0.74 |
| 4,6-dimethyl-2-hydroxy pyrimidine hydrochloride | 0.98 | 0.99 | 0.82 | 0.70 |
| 2,4,5,6-tetra amino pyrimidine sulfate | 1.05 | 1.15 | 1.00 | 0.80 |
| purine | 1.00 | 1.10 | 0.95 | 0.75 |
| 6-aminopurine hydrochloride hemihydrate | 0.95 | 0.99 | 0.82 | 0.67 |
| 1,4-bis (2-hydroxy ethyl) piperazine | 1.10 | 1.25 | 1.03 | 0.75 |
| 1,4-dimethyl-2,5-piperazine dione | 1.15 | 1.29 | 0.96 | 0.75 |
| 4-(2-hydroxyethyl)-1-piperazine ethane sulfonic acid | 1.22 | 1.34 | 1.12 | 0.77 |
| 1-(4-chlorophenyl) piperazine dihydrochloride | 1.12 | 1.09 | 1.01 | 0.74 |
| 1-(2-methoxyphenyl) piperazine hydrochloride | 1.24 | 1.13 | 0.97 | 0.77 |
| 1-(0-tolyl) piperazine hydrochloride | 1.14 | 1.11 | 0.98 | 0.75 |
| 2-methylthio-2-imidazoline hydriodide | 1.25 | 1.15 | 1.10 | 0.80 |
| L-histidine monochloride monohydrate | 1.30 | 1.15 | 1.13 | 0.89 |
| urazole | 1.18 | 1.22 | 1.12 | 0.92 |
| 1-H-tetrazole | 1.09 | 1.05 | 0.93 | 0.77 |
| 3-amino pyrazole | 1.34 | 1.23 | 1.16 | 0.91 |
| 3,5-dimethyl pyrazole-1-carboxamidine nitrate | 1.08 | 1.11 | 0.96 | 0.81 |

As the results indicate, the papers coated with the additive compositions exhibited acceptable optical densities for all colors.

Other embodiments and modifications of the present invention may occur to those skilled in the art subsequent to a review of the information presented herein; these embodiments and modifications, as well as equivalent thereof, are also included within the scope of this invention.

What is claimed is:

1. A recording sheet for receiving printed images which comprises a substrate and an image receiving coating situated on at least one surface of the substrate, said entire image receiving coating comprising an additive material selected from the group consisting of purine compounds, pyrimidine compounds selected from the group consisting of (a) amino pyrimidine compounds; (b) dihydroxy pyrimidine compounds; (c) pyrimidine dione compounds; (d) thiouracil compounds; (e) orotic acid compounds; (f) guanine compounds; (g) xanthine compounds selected from the group consisting of (i) hypoxanthine; (ii) xanthosine; and mixtures thereof; (h) pyrazole pyrimidine compounds; (i) pyrimidine acids; and mixtures thereof, pyrimidine salts, benzimidazole compounds selected from the group consisting of benzimidazole, 2-aminobenzimidazole, 2-amino-5,6-dimethylbenzimidozole, 5-benzimidazole carboxylic acid, 2,4,5-trimethyl benzimidazole, 2-guanidinobenzimidazole, 2-hydroxybenzimidazole, 4-(2-keto-1-benzimidazolinyl) piperidine, and mixtures thereof, imidazolidine compounds of the formula

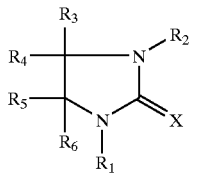

wherein $R_1$ and $R_2$ each, independently of one another, are hydrogen, alkyl, substituted alkyl, amino, amide, amino amide, or carboxyl, and $R_3$, $R_4$, $R_5$, and $R_6$ each, independently of one another, are hydrogen, substituted alkyl, oxo, amino, amide, amino amide, or carboxyl, or wherein either $R_3$ and $R_4$ or $R_5$ and $R_6$ are replaced with a double bond to another atom, wherein when a ring carbon atom is bonded to an R group by a double bond, no other R group is bonded to said ring carbon atom, and X is oxygen, sulfur, or nitrogen, urazole compounds (a) of the formula

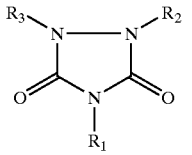

wherein $R_1$, $R_2$, $R_3$, and $R_4$ each, independently of one another, are hydrogen, alkyl, substituted alkyl, aryl, substituted aryl, arylalkyl, or substituted arylalkyl, (b) of the formula

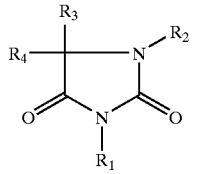

wherein $R_1$, $R_2$, $R_3$, and $R_4$ each, independently of one another, are hydrogen, substituted alkyl, aryl, substituted aryl, arylalkyl, or substituted arylalkyl, or (c) which is β-tetralone hydantoin, pyrazole compounds of the formula

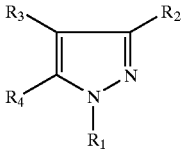

wherein $R_1$, $R_2$, $R_3$, and $R_4$ each, independently of one another, are hydrogen, alkyl, substituted alkyl, amide, hydroxyl, amino, carboxyl, ester, nitrile, alkoxy, halide, or carboxamidinyl, triazole compounds of the formula

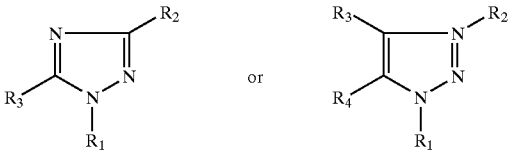

wherein $R_1$, $R_2$, $R_3$, and $R_4$ each, independently of one another, are hydrogen, alkyl, substituted alkyl, mercaptyl, carboxyl, hydrazinyl, aryl, or substituted aryl, tetrazole compounds of the formula

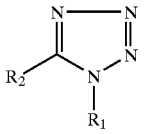

wherein $R_1$ and $R_2$ each, independently of the other, are hydrogen, alkyl, substituted alkyl, or amine, pyrazine compounds, and mixtures thereof, said substrate being selected from the group consisting of paper and transparent polymeric materials, said image receiving coating being suitable for receiving rapid drying images of an aqueous ink.

2. A recording sheet according to claim 1 wherein the additive material is present on the substrate in an amount of from about 1 to about 50 percent by weight of the substrate.

3. A recording sheet according to claim 1 wherein the additive material is present on the substrate in an amount of from about 0.8 to about 40 grams per square meter of the substrate.

4. A recording sheet according to claim 1 wherein the image receiving coating further comprises a polysaccharide binder.

5. A recording sheet according to claim 1 wherein the image receiving coating further comprises a quaternary acrylic copolymer latex binder.

6. A recording sheet according to claim 1 wherein a binder and the additive material are present in relative amounts of from about 10 percent by weight binder and about 90 percent by weight additive material to about 99 percent by weight binder and about 1 percent by weight additive material.

7. A recording sheet according to claim 1 wherein a binder and the additive material are coated onto the substrate in a thickness of from about 1 to about 25 microns.

8. A recording sheet according to claim 1 wherein the substrate is paper.

9. A recording sheet according to claim 1 wherein the substrate is a transparent polymeric material.

10. A recording sheet for receiving printed images which consists essentially of a substrate, an image receiving coating situated on at least one surface of the substrate, said entire image receiving coating containing at least one additive material selected from the group consisting of purine compounds, pyrimidine compounds selected from the group consisting of (a) amino pyrimidine compounds; (b) dihydroxy pyrimidine compounds; (c) pyrimidine dione compounds; (d) thiouracil compounds; (e) orotic acid compounds; (f) guanine compounds; (g) xanthine compounds selected from the group consisting of (i) hypoxanthine; (ii) xanthosine; and mixtures thereof; (h) pyrazole pyrimidine compounds; (i) pyrimidine acids; and mixtures thereof, pyrimidine salts, benzimidazole compounds selected from the group consisting of benzimidozole, 2-aminobenzimidazole, 2-amino-5,6-dimethylbenzimidazole, 5-benzimidazole carboxylic acid, 2,4,5-trimethyl benzimidazole, 2-guanidinobenzimidazole, 2-hydroxybenzimidazole, 4-(2-keto-1-benzimidazolinyl) piperidine, and mixtures thereof, imidazolidine compounds of the formula

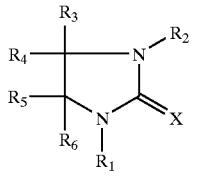

wherein $R_1$ and $R_2$ each, independently of one another, are hydrogen, alkyl, substituted alkyl, amino, amide, amino amide, or carboxyl, and $R_3$, $R_4$, $R_5$ and $R_6$ each, independently of one another, are hydrogen, substituted alkyl, oxo, amino, amide, amino amide, or carboxyl, or wherein either $R_3$ and $R_4$ or $R_5$ and $R_6$ are replaced with a double bond to another atom, wherein when a ring carbon atom is bonded to an R group by a double bond, no other R group is bonded to said ring carbon atom, and X is oxygen, sulfur, or nitrogen, urazole compounds (a) of the formula

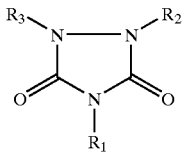

wherein $R_1$, $R_2$, $R_3$, and $R_4$ each, independently of one another, are hydrogen, alkyl, substituted alkyl, aryl, substituted aryl, arylalkyl, or substituted arylalkyl, (b) of the formula

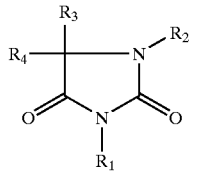

wherein $R_1$, $R_2$, $R_3$, and $R_4$ each, independently of one another, are hydrogen, substituted alkyl, aryl, substituted aryl, arylalkyl, or substituted arylalkyl, or (c) which is β-tetralone hydantoin, pyrazole compounds of the formula

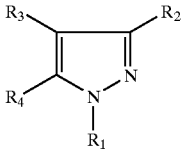

wherein $R_1$, $R_2$, $R_3$, and $R_4$ each, independently of one another, are hydrogen, alkyl, substituted alkyl, amide, hydroxyl, amino, carboxyl, ester, nitrile, alkoxy, halide, or carboxamidinyl, triazole compounds of the formula

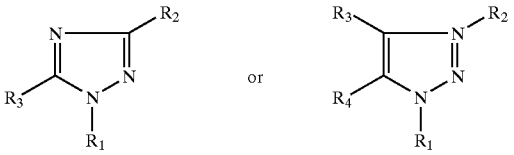

wherein $R_1$, $R_2$, $R_3$, and $R_4$ each, independently of one another, are hydrogen, alkyl, substituted alkyl, mercaptyl, carboxyl, hydrazinyl, aryl, or substituted aryl, tetrazole compounds of the formula

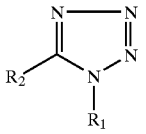

wherein $R_1$ and $R_2$ each, independently of the other, are hydrogen, alkyl, substituted alkyl, or amine, pyrazine compounds, and mixtures thereof, an optional binder, an optional antistatic agent, an optional biocide, and an optional filler, said substrate being selected from the group consisting of paper and transparent polymeric materials, said image receiving coating being suitable for receiving rapid drying images of an aqueous ink.

11. A recording sheet for receiving printed images which comprises a substrate and an image receiving coating situated on at least one surface of the substrate, said entire image receiving coating comprising an additive which is a purine compound, said substrate being selected from the group consisting of paper and transparent polymeric materials, said image receiving coating being suitable for receiving rapid drying images of an aqueous ink.

12. A recording sheet for receiving printed images which comprises a substrate and an image receiving coating situated on at least one surface of the substrate, said entire image receiving coating comprising an additive selected from the group consisting of (1) purine; (2) 6-amino purine; (3) 6-methoxy purine; (4) 6-mercaptopurine, (5) 2-amino-6-chloropurine; (6) 2-amino-6,8-dihydroxy purine; (7) theophylline; (8) kinetin; (9) 1-methyl adenine; (10) 3-methyl adenine; (11) adenosine; (12) inosine; (13) 6-mercaptopurine riboside; (14) 6-amino purine acid salts; (15) 2,6-diamino-8-purinol acid salts; and mixtures thereof, said substrate being selected from the group consisting of paper and transparent polymeric materials, said image receiving coating being suitable for receiving rapid drying images of an aqueous ink.

13. A recording sheet for receiving printed images which comprises a substrate and an image receiving coating situated on at least one surface of the substrate, said entire image receiving coating comprising an additive material which is a pyrimidine compound selected from the group consisting of (a) amino pyrimidine compounds; (b) dihydroxy pyrimidine compounds; (c) pyrimidine dione compounds; (d) thiouracil compounds; (e) orotic acid compounds; (f) guanine compounds; (g) xanthine compounds selected from the group consisting of (i) hypoxanthine; (ii) xanthosine; and mixtures thereof; (h) pyrazole pyrimidine compounds; (i) pyrimidine acids; (i) pyrimidine salts, and mixtures thereof, said substrate being selected from the group consisting of paper and transparent polymeric materials, said image receiving coating being suitable for receiving rapid drying images of an aqueous ink.

14. A recording sheet for receiving printed images which comprises a substrate and an image receiving coating situated on at least one surface of the substrate, said entire image receiving coating comprising an additive material, wherein the additive is selected from the group consisting of (a) amino pyrimidine compounds; (b) dihydroxy pyrimidine compounds; (c) pyrimidine dione compounds; (d) thiouracil compounds; (e) orotic acid compounds; (f) guanine compounds; (g) pyrazole pyrimidine compounds; (h) pyrimidine acids; and mixtures thereof, said substrate being selected from the group consisting of paper and transparent polymeric materials, said image receiving coating being suitable for receiving rapid drying images of an aqueous ink.

15. A recording sheet for receiving printed images which comprises a substrate and an image receiving coating situated on at least one surface of the substrate, said entire image receiving coating comprising an additive material selected from the group consisting of (1) 2-amino pyrimidine; (2) 2-amino-4-methyl pyrimidine; (3) 2-amino-5-nitropydmidine; (4) 2-amino-5-bromopyrimidine; (5) 2-amino-4-chloro-6-methyl pyrimidine; (6) 2-amino-4,6-dimethyl pyrimidine; (7) 2-amino-4-hydroxy-6-methyl pyrimidine; (8) 2-amino-4,6-dichloropyrimidine; (9) 2-amino-5-bromo-6-methyl-4-pyrimidinol; (10) 4-aminopyrimidine; (11) 4,5-diamino pyrimidine; (12) 4-amino-2,6dimethyl pyrimidine; (13) 2,4-diamino-6-hydroxypyrimidine; (14) 2,6-diamino-4-chloro pyrimidine; (15) 2,4,6-triamino pyrimidine; (16) 5-nitroso-2,4,6-triamino pyrimidine; and mixtures thereof, said substrate being selected from the group consisting of paper and transparent polymeric materials, said image receiving coating being suitable for receiving rapid drying images of an aqueous ink.

16. A recording sheet for receiving printed images which comprises a substrate and an image receiving coating situated on at least one surface of the substrate, said entire image receiving coating comprising an additive selected from the group consisting of (1) 4,6-dihydroxy pyrimidine; (2) 4,6-dihydroxy-2-amino pyrimidine; (3) 4,6-dihydroxy-2-methyl pyrimidine; (4) 4,6-dihydroxy-5-nitropyrimidine; (5) 2,4-dihydroxy-5-methyl pyrimidine; (6) 2,4-dihydroxy-6-methyl pyrimidine; (7) 2,4-dihydroxy-5,6-dimethyl pyrimidine; (8) 2,6-dihydroxy pyrimidine-5-carboxylic acid; (9) 2,6-dihydroxy-4-amino pyrimidine; (10) 2,4,5-trihydroxy pyrimidine; and mixtures thereof, said substrate being selected from the group consisting of paper and transparent polymeric materials, said image receiving coating being suitable for receiving rapid drying images of an aqueous ink.

17. A recording sheet for receiving printed images which comprises a substrate and an image receiving coating situated on at least one surface of the substrate, said entire image receiving coating comprising an additive selected from the group consisting of (1) 2,4 (1H,3H)-pyrimidine dione; (2) 5-amino uracil; (3) 5-nitrouracil; (4) 5-iodouracil; (5) 5-(hydroxymethyl) uracil; (6) 5,6-dihydrouracil; (7) 6-amino-1-methyl uracil; (8) 5,6-diamino-1,3-dimethyl uracil; (9) uridine; (10) 5-methyl uridine; (11) 5-iodouridine; (12) thimidine; and mixtures thereof, said substrate being selected from the group consisting of paper and transparent polymeric materials, said image receiving coating being suitable for receiving rapid drying images of an aqueous ink.

18. A recording sheet for receiving printed images which comprises a substrate and an image receiving coating situated on at least one surface of the substrate, said entire image receiving coating comprising an additive selected from the group consisting of (1) 2-thiouracil; (2) 5-methyl-2-thiouracil; (3) 6-amino-5nitroso-2-thiouracil; (4) 4-thiouridine; (5) 2-thiocytidine; (6) orotic acid; (7) hydroorotic acid; (8) 5-aminoorotic acid; (9) methylorotate; (10) 5-nitrobarbituric acid; (11) violuric acid; (12) 1-methyl uric acid; (13) guanine; (14) guanosine; (15) hypoxonthine; (16) xanthosine; (17) 4-hydroxypyrazolo[3,4-d]pyrimidine; (18) 4-mercapto-1H-pyrozolo-[3,4-d]-pyrimidine; (19) folic acid; (20) folinic acid salts; and mixtures thereof, said substrate being selected from the group consisting of paper and transparent polymeric materials, said image receiving coating being suitable for receiving rapid drying images of an aqueous ink.

19. A recording sheet according for receiving printed images which comprises a substrate and an image receiving coating situated on at least one surface of the substrate, said entire image receiving coating comprising an additive material which is a pyrimidine salt compound, said substrate being selected from the group consisting of paper and transparent polymeric materials, said image receiving coating being suitable for receiving rapid drying images of an aqueous ink.

20. A recording sheet according for receiving printed images which comprises a substrate and an image receiving coating situated on at least one surface of the substrate, said entire image receiving coating comprising an additive material selected from the group consisting of (1) 2-hydroxypyrimidine acid salts; (2) 2-hydroxy-4-methyl pyrimidine acid salts; (3) 4,6-dimethyl-2-hydroxypyrimidine acid salts; (4) 2-mercapto-4-methyl pyrimidine acid salts; (5) 4,6-diamino pyrimidine acid salts; (6) 4,5,6-triamino pyrimidine acid salts; (7) 4,5-diamino-6-dihydroxy pyrimidine acid salts; (8) 2,4-diamino-6-mercapto pyrimidine acid salts; (9) 2,4-diamino-6-hydroxy pyrimidine acid salts; (10) 6-hydroxy-2,4,5-triamino pyrimidine acid salts; (11) 5,6-diamino-2,4-dihydroxy pyrimidine acid salts; (12) $N^4$-(2-amino-4-pyrimidinyl) sulfanilamide acid salts; (13) 4,5,6-triamino-2(1H)-pyrimidinethione acid salts; (14) 2,4,5,6-tetraamino pyrimidine acid salts; (15) cyclocytidine acid salts; (16) cytosine arabinoside acid salts; and mixtures thereof, said substrate being selected from the group consisting of paper and transparent polymeric materials, said image receiving coating being suitable for receiving rapid drying images of an aqueous ink.

21. A recording sheet according for receiving printed images which comprises a substrate and an image receiving coating situated on at least one surface of the substrate, said entire image receiving coating comprising an additive material which is a benzimidazole compound, said substrate being selected from the group consisting of paper and transparent polymeric materials, said image receiving coating being suitable for receiving rapid drying images of an aqueous ink.

22. A recording sheet according for receiving printed images which comprises a substrate and an image receiving coating situated on at least one surface of the substrate, said entire image receiving coating comprising an additive material selected from the group consisting of (1) benzimidazole; (2) 2-aminobenzimidazole; (3) 2-amino-5,6-dimethlybenzimidozole; (4) 5-benzimidozole carboxylic acid; (5) 2,4,5-trimethyl benzimidazole; (6) 2-guanidinobenzimidazole; (7) 2-hydroxybenzimidazole; (8) 4-(2-keto-1-benzimidazolinyl)piperidine; and mixtures thereof, said substrate being selected from the group consisting of paper and transparent polymeric materials, said image receiving coating being suitable for receiving rapid drying images of an aqueous ink.

23. A recording sheet for receiving printed images which comprises a substrate and an image receiving coating situated on at least one surface of the substrate, said entire image receiving coating comprising an additive material, wherein the additive is an imidazolidine compound of the formula

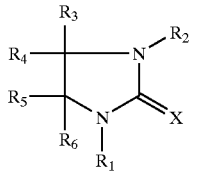

wherein $R_1$ and $R_2$ each, independently of one another, are hydrogen, alkyl, substituted alkyl, amino, amide, amino amide, or carboxyl, and $R_3$, $R_4$, $R_5$, and $R_6$ each, independently of one another, are hydrogen, substituted alkyl, oxo, amino, amide, amino amide, or carboxyl, or wherein either $R_3$ and $R_4$ or $R_5$ and $R_6$ are replaced with a double bond to another atom, wherein when a ring carbon atom is bonded to an R group by a double bond, no other R group is bonded to said ring carbon atom, and X is oxygen, sulfur, or nitrogen, said substrate being selected from the group consisting of paper and transparent polymeric materials, said image receiving coating being suitable for receiving rapid drying images of an aqueous ink.

24. A recording sheet for receiving printed images which comprises a substrate and an image receiving coating situated on at least one surface of the substrate, said entire image receiving coating comprising an additive material, wherein the additive is selected from the group consisting of (1) 2-imidazolidine thione; (2) 2-imidazolidone; (3) hydantoin; (4) 1-methyl hydantoin; (5) creatinine; (6) 2-thiohydrantoin; (7) 5-hydantoin acetic acid; (8) 5-ureidohydantoin; (9) 2-imidazolidone-4-carboxylic acid; and mixtures thereof, said substrate being selected from the group consisting of paper and transparent polymeric materials, said image receiving coating being suitable for receiving rapid drying images of an aqueous ink.

25. A recording sheet for receiving printed images which comprises a substrate and an image receiving coating situated on at least one surface of the substrate, said entire image receiving coating comprising an additive material, wherein the additive is a urazole compound (a) of the formula

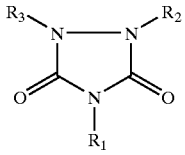

wherein $R_1$, $R_2$, $R_3$, and $R_4$ each, independently of one another, are hydrogen, alkyl, substituted alkyl, aryl, substituted aryl, arylalkyl, or substituted arylalkyl, (b) of the formula

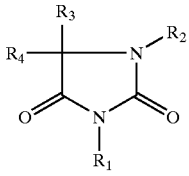

wherein $R_1$, $R_2$, $R_3$, and $R_4$ each, independently of one another, are hydrogen, substituted alkyl, aryl, substituted aryl, arylalkyl, or substituted arylalkyl, or (c) which is β-tetralone hydantoin, said substrate being selected from the group consisting of paper and transparent polymeric materials, said image receiving coating being suitable for receiving rapid drying images of an aqueous ink.

26. A recording sheet for receiving printed images which comprises a substrate and an image receiving coating situated on at least one surface of the substrate, said entire image receiving coating comprising an additive material which is selected from the group consisting of (1) urazole; (2) 1-methyl urazole; (3) 4-phenyl urazole; (4) 5-(4-hydroxyphenyl)-5-phenyl hydantoin; (5) β-tetralone hydantoin; and mixtures thereof, said substrate being selected from the group consisting of paper and transparent polymeric materials, said image receiving coating being suitable for receiving rapid drying images of an aqueous ink.

27. A recording sheet for receiving printed images which comprises a substrate and an image receiving coating situated on at least one surface of the substrate, said entire image receiving coating comprising an additive material which is a pyrazole compound of the formula

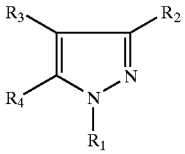

wherein $R_1$, $R_2$, $R_3$, and $R_4$ each, independently of one another, are hydrogen, alkyl, substituted alkyl, amide, hydroxyl, amino, carboxyl, ester, nitrile, alkoxy, halide, or carboxamidinyl, said substrate being selected from the group consisting of paper and transparent polymeric materials, said image receiving coating being suitable for receiving rapid drying images of an aqueous ink.

28. A recording sheet for receiving printed images which comprises a substrate and an image receiving coating situated on at least one surface of the substrate, said entire image receiving coating comprising an additive material selected from the group consisting of (1) pyrazole; (2) 4-pyrazole carboxylic acid; (3) ethyl 4-pyrazole carboxylate; (4) 3,5-pyrazole dicarboxylic acid; (5) 3-amino pyrazole; (6) 3-amino-5-hydroxypyrazole; (7) 3-amino-5-methylpyrazole; (8) 3-amino-4-pyrazole carbonitrile; (9) 3-amino-4-pyrzaolecarboxylic acid; (10) 3-amino-4-carbethoxypyrazole; (11) 5-amino-1-ethylpyrazole; (12) 4-bromo-3-methyl pyrazole; (13) 3,5-dimethyl pyrazole; (14) 3,5-dimethyl pyrazole-1-carboxamide; (15) 4-bromo-3,5-dimethyl pyrazole; (16) 3,5-dimethylpyrazole-1-methanol; (17) 4-methyl pyrazole acid salts; (18) 3,4-diamino-5-hydroxy pyrazole acid salts; (19) 3,5-dimethyl pyrazole-1-carboxamidine acid salts; (20) 3-amino-4-pyrazole carboxamide acid salts; (21) of 6-amino indazole acid salts; and mixtures thereof, said substrate being selected from the group consisting of paper and transparent polymeric materials, said image receiving coating being suitable for receiving rapid drying images of an aqueous ink.

29. A recording sheet for receiving printed images which comprises a substrate and an image receiving coating situated on at least one surface of the substrate said entire image receiving coating comprising an additive material selected from the group consisting of triazole compounds, said substrate being selected from the group consisting of paper and transparent polymeric materials, said image receiving coating being suitable for receiving rapid drying images of an aqueous ink.

30. A recording sheet for receiving printed images which comprises a substrate and an image receiving coating situated on at least one surface of the substrate, said entire image receiving coating comprising an additive material selected from the group consisting of (1) 1,2,4-triazole; (2) 1,2,4-triazole salts; (3) 1,2,3-triazole-4,5-dicarboxylic acid; (4) nitron; and mixtures thereof, said substrate being selected from the group consisting of paper and transparent polymeric materials, said image receiving coating being suitable for receiving rapid drying images of an aqueous ink.

31. A recording sheet for receiving printed images which comprises a substrate and an image receiving coating situated on at least one surface of the substrate, said entire image receiving coating comprising an additive material which is a tetrazole compound of the formula

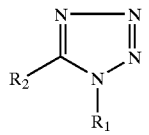

wherein $R_1$ and $R_2$ each, independently of the other, are hydrogen, alkyl, substituted alkyl, or amine, said substrate being selected from the group consisting of paper and transparent polymeric materials, said image receiving coating being suitable for receiving rapid drying images of an aqueous ink.

32. A recording sheet for receiving printed images which comprises a substrate and an image receiving coating situated on at least one surface of the substrate, said entire image receiving coating comprising an additive material which is selected from the group consisting of (1) 1-H-tetrazole; (2) 5-amino tetrazole; and mixtures thereof, said substrate being selected from the group consisting of paper and transparent polymeric materials, said image receiving coating being suitable for receiving rapid drying images of an aqueous ink.

33. A recording sheet for receiving printed images which comprises a substrate and an image receiving coating situated on at least one surface of the substrate, said entire image receiving coating comprising an additive material which is a pyrazine compound, said substrate being selected from the group consisting of paper and transparent polymeric materials, said image receiving coating being suitable for receiving rapid drying images of an aqueous ink.

34. A recording sheet according for receiving printed images which comprises a substrate and an image receiving coating situated on at least one surface of the substrate, said entire image receiving coating comprising an additive material selected from the group consisting of (1) 5-methyl-2-pyrazine carboxylic acid; (2) pyrazine amide; (3) 2,3-pyrazine dicarboxamide; (4) 4-pyridazine carboxylic acid; (5) 2,3-pyrazine dicarboxylic acid; (6) lumazine; (7) xanthopterin; (8) 2-quinoxazoline carboxylic acid; (9) 2-quinoxalinol; (10) 2,3-dihydroxy quinoxaline; (11) phenazine acid salts; and mixtures thereof, said substrate being selected from the group consisting of paper and transparent polymeric materials, said image receiving coating being suitable for receiving rapid drying images of an aqueous ink.

35. A recording sheet for receiving printed images which comprises a substrate and an image receiving coating situated on at least one surface of the substrate, said entire image receiving coating comprising a monomeric additive material selected from the group consisting of purine compounds, pyrimidine compounds selected from the group consisting of (a) amino pyrimidine compounds; (b) dihydroxy pyrimidine compounds; (c) pyrimidine dione compounds, (d) thiouracil compounds; (e) orotic acid compounds; (f) guanine compounds; (g) xanthine compounds selected from the group consisting of (i) hypoxanthine; (ii) xanthosine; and mixtures thereof; (h) pyrazole pyrimidine compounds; (i) pyrimidine acids; and mixtures thereof, pyrimidine salts, benzimidazole compounds selected from the group consisting of benzimidazole, 2-aminobenzimidazole, 2-amino-5,6-dimethylbenzimidazole, 5-benzimidazole carboxylic acid, 2,4,5-trimethyl benzimidazole, 2-guanidinobenzimidazole, 2-hydroxybenzimidazole, 4-(2-keto-1-benzimidazolinyl) piperidine, and mixtures thereof, imidazolidine compounds of the formula

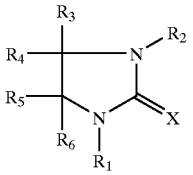

wherein $R_1$ and $R_2$ each, independently of one another, are hydrogen, alkyl, substituted alkyl, amino, amide, amino amide, or carboxyl, and $R_3$, $R_4$, $R_5$, and $R_6$ each, independently of one another, are hydrogen, substituted alkyl, oxo, amino, amide, amino amide, or carboxyl, or wherein either $R_3$ and $R_4$ or $R_5$ and $R_6$ are replaced with a double bond to another atom, wherein when a ring carbon atom is bonded to an R group by a double bond, no other R group is bonded to said ring carbon atom, and X is oxygen, sulfur, or nitrogen, urazole compounds (a) of the formula

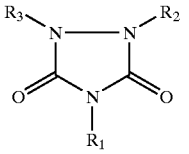

wherein $R_1$, $R_2$, $R_3$, and $R_4$ each, independently of one another, are hydrogen, alkyl, substituted alkyl, aryl, substituted aryl, arylalkyl, or substituted arylalkyl, (b) of the formula

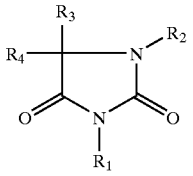

wherein $R_1$, $R_2$, $R_3$, and $R_4$ each, independently of one another, are hydrogen, substituted alkyl, aryl, substituted aryl, arylalkyl, or substituted arylalkyl, or (c) which is β-tetralone hydantoin, pyrazole compounds of the formula

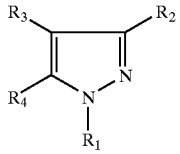

wherein $R_1$, $R_2$, $R_3$, and $R_4$ each, independently of one another, are hydrogen, alkyl, substituted alkyl, amide, hydroxyl, amino, carboxyl, ester, nitrile, alkoxy, halide, or carboxamidinyl, triazole compounds of the formula

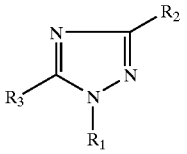

or

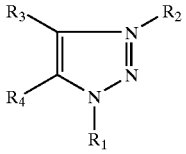

wherein $R_1$, $R_2$, $R_3$, and $R_4$ each, independently of one another, are hydrogen, alkyl, substituted alkyl, mercaptyl, carboxyl, hydrazinyl, aryl, or substituted aryl, tetrazole compounds of the formula

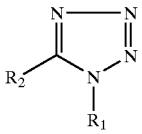

wherein $R_1$ and $R_2$ each, independently of the other, are hydrogen, alkyl, substituted alkyl, or amine, pyrazine compounds, and mixtures thereof, said substrate being selected from the group consisting of paper and transparent polymeric materials, said image receiving coating being suitable for receiving rapid drying images of an aqueous ink.

36. A recording sheet for receiving printed images which consists essentially of a substrate, an image receiving coating situated on at least one surface of the substrate, said entire image receiving coating containing at least one monomeric additive material selected from the group consisting of purine compounds, pyrimidine compounds selected from the group consisting of (a) amino pyrimidine compounds; (b) dihydroxy pyrimidine compounds; (c) pyrimidine dione compounds; (d) thiouracil compounds; (e) orotic acid compounds; (f) guanine compounds; (g) xanthine compounds selected from the group consisting of (i) hypoxanthine; (ii) xanthosine; and mixtures thereof; (h) pyrazole pyrimidine compounds; (i) pyrimidine acids; and mixtures thereof, pyrimidine salts, benzimidazole compounds selected from the group consisting of benzimidazole, 2-aminobenzimidazole, 2-amino-5,6-dimethylbenzimidazole, 5-benzimidazole carboxylic acid, 2,4,5-trimethyl benzimidazole, 2-guanidinobenzimidazole, 2-hydroxybenzimidazole, 4-(2-keto-1-benzimidazolinyl) piperidine, and mixtures thereof, imidazolidine compounds of the formula

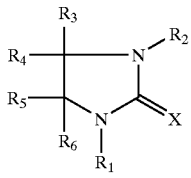

wherein $R_1$ and $R_2$ each, independently of one another, are hydrogen, alkyl, substituted alkyl, amino, amide, amino amide, or carboxyl, and $R_3$, $R_4$, $R_5$, and $R_6$ each, independently of one another, are hydrogen, substituted alkyl, oxo, amino, amide, amino amide, or carboxyl, or wherein either $R_3$ and $R_4$ or $R_5$ and $R_6$ are replaced with a double bond to another atom, wherein when a ring carbon atom is bonded to an R group by a double bond, no other R group is bonded to said ring carbon atom, and X is oxygen, sulfur, or nitrogen, urazole compounds (a) of the formula

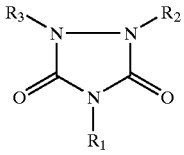

wherein $R_1$, $R_2$, $R_3$, and $R_4$ each, independently of one another, are hydrogen, alkyl, substituted alkyl, aryl, substituted aryl, arylalkyl, or substituted arylalkyl, (b) of the formula

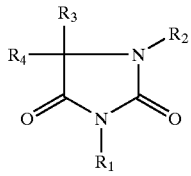

wherein $R_1$, $R_2$, $R_3$, and $R_4$ each, independently of one another, are hydrogen, substituted alkyl, aryl, substituted aryl, arylalkyl, or substituted arylalkyl, or (c) which is β-tetralone hydantoin, pyrazole compounds of the formula

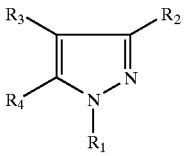

wherein $R_1$, $R_2$, $R_3$, and $R_4$ each, independently of one another, are hydrogen, alkyl, substituted alkyl, amide, hydroxyl, amino, carboxyl, ester, nitrile, alkoxy, halide, or carboxamidinyl, triazole compounds of the formula

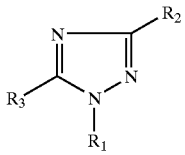

or

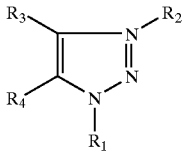

wherein $R_1$, $R_2$, $R_3$, and $R_4$ each, independently of one another, are hydrogen, alkyl, substituted alkyl, mercaptyl, carboxyl, hydrazinyl, aryl, or substituted aryl, tetrazole compounds of the formula

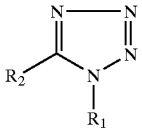

wherein $R_1$ and $R_2$ each, independently of the other, are hydrogen, alkyl, substituted alkyl, or amine, pyrazine compounds, and mixtures thereof, an optional binder, an optional antistatic agent, an optional biocide, and an optional filler, said substrate being selected from the group consisting of paper and transparent polymeric materials, said image receiving coating being suitable for receiving rapid drying images of an aqueous ink.

* * * * *